US012729523B2

(12) United States Patent
Zeltner et al.

(10) Patent No.: US 12,729,523 B2
(45) Date of Patent: Sep. 8, 2026

(54) HEATER AND RELATED CONTROL SYSTEM

(71) Applicant: PolyJohn Enterprises LLC, Whiting, IN (US)

(72) Inventors: Martin Zeltner, Uxbridge (CA); Michael Scot Cooper, Valparaiso, IN (US); Arash Sheikhtaheri, Newmarket (CA)

(73) Assignee: Poly John Enterprises, LLC, Whiting, IN (US)

( * ) Notice: Subject to any disclaimer, the term of this patent is extended or adjusted under 35 U.S.C. 154(b) by 316 days.

(21) Appl. No.: 18/354,291

(22) Filed: Jul. 18, 2023

(65) Prior Publication Data

US 2024/0026662 A1 Jan. 25, 2024

Related U.S. Application Data

(60) Provisional application No. 63/390,742, filed on Jul. 20, 2022.

(51) Int. Cl.
*E03C 1/044* (2006.01)
*E03C 1/182* (2006.01)

(52) U.S. Cl.
CPC ..... *E03C 1/044* (2013.01); *E03C 1/182* (2013.01)

(58) Field of Classification Search
CPC ..... E03C 1/14; E03C 1/16; E03C 1/18; E03C 1/182; E03C 1/044
See application file for complete search history.

(56) References Cited

U.S. PATENT DOCUMENTS 4,144,596 A * 3/1979 MacFarlane ..... A47K 10/48 4/628
5,704,078 A * 1/1998 Chandler ..... A47K 11/02 4/449
6,161,228 A 12/2000 Wietecha
8,245,330 B2 * 8/2012 Atkinson ..... E03B 11/02 4/625
10,271,691 B1 * 4/2019 Boyle ..... A47K 1/02
11,047,119 B2 * 6/2021 Gallob ..... E03C 1/044
(Continued)

FOREIGN PATENT DOCUMENTS

BE 1002543 A6 3/1991
CN 106836390 A 6/2017
WO 2017138112 A1 8/2017

OTHER PUBLICATIONS

Machine Translation of BE 1002543. Espacenet. (Year: 2025).*
(Continued)

*Primary Examiner* — Erin Deery
(74) *Attorney, Agent, or Firm* — Harness, Dickey & Pierce, P.L.C.

(57) ABSTRACT

A heating and pumping system is disclosed. The system may be usable in a portable sink that includes a clean water source having incorporated therein the system with a submersible heater. The heater may include an enclosed heating element that transfers thermal energy (heat) to the water in the clean tank. A powered and/or automatic pump may be provided to move water relative to the heater. A controller with the system may control the operation of the heater and/or the pump to achieve the selected temperature of the clean water.

21 Claims, 18 Drawing Sheets

(56) References Cited

U.S. PATENT DOCUMENTS

| | | | | |
|---|---|---|---|---|
| 2014/0053909 | A1 | 2/2014 | Savage | |
| 2022/0290418 | A1* | 9/2022 | Dombrowsky | E03C 1/182 |

OTHER PUBLICATIONS

PSW3-2000G Encore, "Heated Wash Stand with Wheels Technical Information" Aug. 2020, 4 pages.
Easyheat, "In-Line Heater", 2 pages.
Examiner's Report received by the Canadian Intellectual Patent Office for Canadian Application No. 3,262,678 dated Apr. 29, 2025, 4 pages.
Invitation to Pay Fees and Partial International Search for related International Application No. PCT/US2023/028096; date of mailing: Nov. 2, 2023; 12 pages.
International Preliminary Report on Patentability for related International Application No. PCT/US2023/028096, dated: Jan. 30, 2025, 14 pages.
International Search Report and Written Opinion for related International Application No. PCT/US2023/028096; dated: Feb. 15, 2024; 24 pages.
Examiner's Report received by the Canadian Intellectual Patent Office for Canadian Application No. 3,262,678 dated Jan. 19, 2026, 2 pages.

* cited by examiner

HEATER AND RELATED CONTROL SYSTEM

CROSS-REFERENCE TO RELATED APPLICATIONS

This application claims the benefit of U.S. Provisional Application No. 63/390,742, filed on Jul. 20, 2022. The entire disclosure(s) of (each of) the above application(s) is (are) incorporated herein by reference.

BACKGROUND

This section provides background information related to the present disclosure which is not necessarily prior art.

Portable sink assemblies include structures that may be positioned for various events and in various locations. For example, a portable sink may be placed at an event, such as outdoor concert, or festival, to allow a convenient location for washing hands or cleansing items. Further, portable sinks may be placed at locations that do not include indoor plumbing, such as at entry and exit points at various buildings, such as office buildings and day care centers. Portable heating systems can include those such as the Encore™ portable sink sold by PolyJohn having a place of business at Whiting, Indiana.

A portable sink may include a sink that is a self-contained including a source of clean water and a container for holding gray water. The portable sink may further include various structures or features that will allow it to be easily moved, such as built-in wheels casters. Further, the sink may be formed of materials that are generally lightweight and robust. In various embodiments, for example, the sink may be formed of a polymer or copolymer that are formed into the sink structure.

In the sink structure, a basin may be included that allows for capture of water after being used to clean an item, such as hands of a user, arms of a user, items held by a user, or the like. The sink may further include a pump assembly, such as a foot pump assembly to pump water from the clean water basin through an outlet or faucet for washing the item. The user may, therefore, manually operate the pump to move water from the clean water source through the faucet to the basin.

SUMMARY

This section provides a general summary of the disclosure, and is not a comprehensive disclosure of its full scope or all of its features.

A sink that includes a clean water source having incorporated therein a submersible heater is disclosed that is operable to be used in any appropriate use, including any appropriate selected locations. The sink assembly may be portable, semi-portable, and/or permanently located at a location. In various embodiments, the sink assembly may be connected to a water source (e.g., a water) main that provides a pressure and source of water. In various embodiments, the water source may be a fixed volume and a selected pump may provide pressure for water flow.

The heater assembly of the sink assembly may include one or more enclosed heating element that transfers thermal energy (heat) to the water in the clean tank. The heater, therefore, may maintain the water in the clean tank at a selected temperature. A powered and/or automatic pump may be provide to move water relative to the heater. Thus, the volume of the heater may be efficiently heated to a selected temperature. The portable sink may further include a controller to control the operation of the heater and/or the pump to achieve the selected temperature of the clean water.

In various embodiments, the portable sink includes a heating assembly to heat water in the clean water source. The heater may be associated with a pump that pumps water past or through the heather to increase and/or maintain a selected temperature of the water in the clean water basin. In various embodiments, the heater may be a submersible heater that is positioned in a housing to cause water to flow passed the heater. Further, a pump may be used to move the water such that water is circulated passed the heater within the clean water basin.

In addition, a controller may be used to operate one or both of the heater and the pump. For example, the controller may be operated to operate the pump to pump water at a selected rate. The controller may also control a heat power of the heater, such as by a voltage or an amperage regulation. The controller may further receive signals from one or more sensors to sense a temperature to determine a duty cycle of one or both of the pump or the heater to maintain a selected temperature. The controller may further operate the heater and the pump to provide a selected efficiency, such as energy use, while maintaining the selected temperature.

The controller may further include various inputs and/or outputs to control and/or monitor various other features of the sink assembly. Additional, outputs of the controller may be provided to control various additional features, such as sterilization units relative to the heater. For example, an ultraviolet (UV) light source may be provided to assist in maintaining a cleanliness of the water in the clean water basin. Therefore, a controller may be used to operate one or more items or features included in the portable sink assembly.

The heater and control system is understood to operate with any appropriate water volume and/or dispending system. Thus, the Recirculating Heating and control System may be used and/or place with a portable sink, fixed sink, cleaning station, washroom facility, etc. The discussion herein regarding a portable sink is, therefore, merely exemplary.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
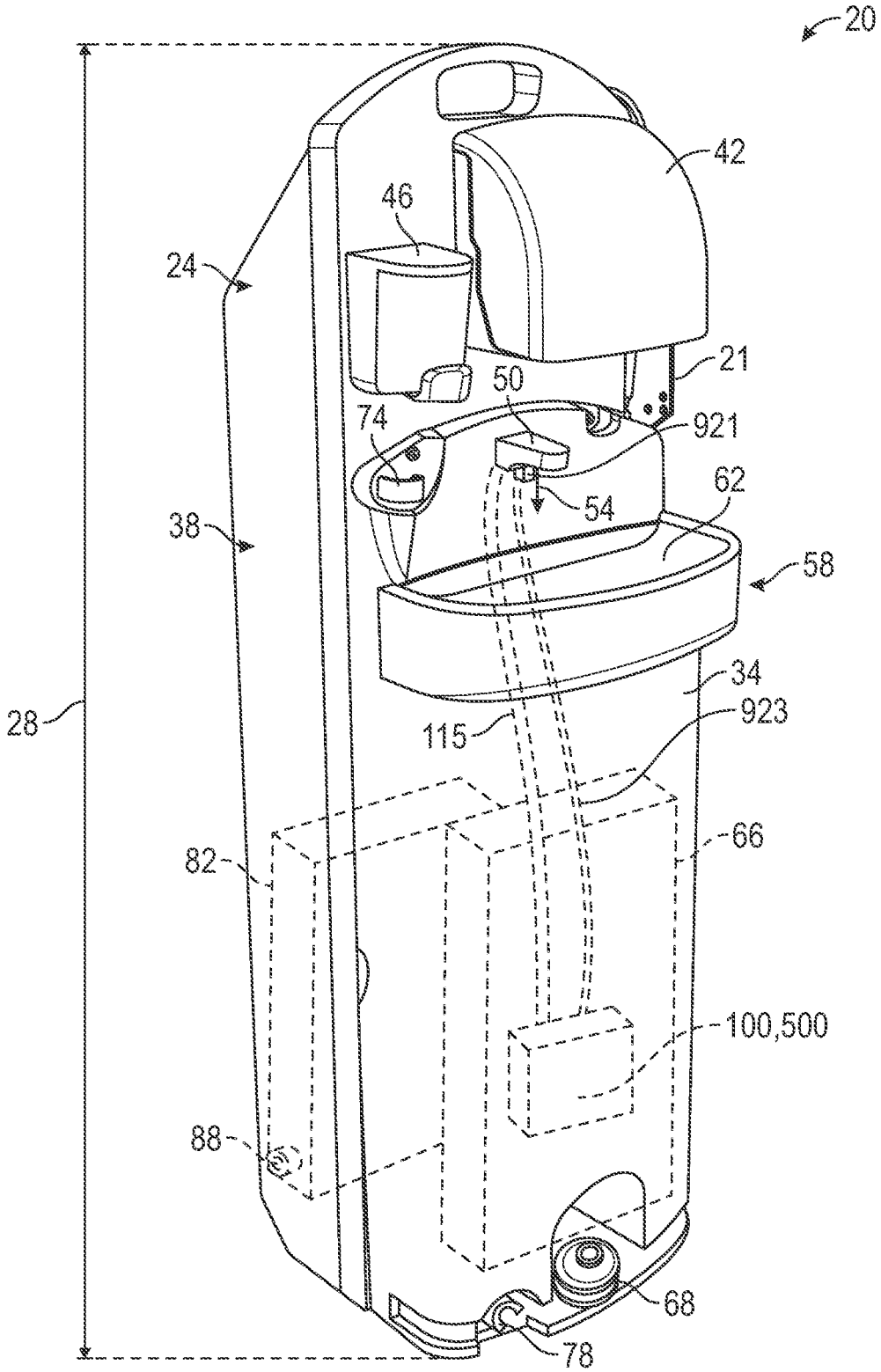
FIG. 1 is a perspective environmental view of a portable sink with a heater and controller assembly, according to various embodiments.

With initial reference to FIG. 1, a portable sink 20 is illustrated. The portable sink may include an outer housing or housing assembly 24. The housing assembly may be manipulated by a single person or a selected number of people and/or machinery to be moved from one location to another. In various embodiments, however, the portable sink 20 may include a non-permanently plumbed water supply and gray water containment portion included within the housing assembly 24. In various embodiments, for example, the housing assembly 24 may include a height dimension 28 that is about 4 feet to about 7 feet, including about 5 feet and 8 inches tall. The height 28, however, may be any appropriate dimension that may allow for efficient transport of the portable sink 20.

The housing assembly 24 may include one or more units or portions that are assembled together. For example, the housing assembly 24 may include a washbasin assembly 34 for that may be a front housing and a gray water housing 38 that may be a rear housing. The two housing members 34, 38 may be assembled together in a selected manner, as is generally understood by one skilled in the art. The portable sink 20 may further include additional features such as a paper towel dispenser 42 and a container for a liquid dispenser 46, such as a liquid soap, hand sanitizer, or the like. Further, the portable sink 20 may include a faucet assembly also referred to as a spigot or spigot assembly 50 through which water may exit, generally in the direction of the arrow 54 towards and/or into a washbasin portion 58 that may include an internal bowl or surface 62.

The washbasin housing 34 may include an internal volume that is either defined by the housing 34 and/or includes a separate and included volume housing 66 that houses clean water and may also be referred to as a clean water housing 66. The clean water may be pumped by a selected pump, such as a manual foot pump 68 such that it is directed through the faucet 50 in generally the direction of the arrow 54. As discussed herein, a powered pump may also be used or alternatively be used to move water in the sink 20. Thus, the foot pump 68 may be a switch that operates the pump. Further, the foot pump 68 may also or alternatively be a switch to open or close a valve from a water main (e.g., municipal water supply) to move water within the sink 20. Also, the municipal water supply may be provided as a replacement and/or in addition to the clean water volume 66. The clean water volume 66 may be filled through a selected filling port, such as a clean water fill port 74. The clean water volume 66, however, may be filled in any appropriate manner and the fill port 74 is merely exemplary. Further, the clean water volume 66 may include an outlet port 78 if the clean water from the clean water volume 66 is selected to be removed without being dispensed through the faucet 50.

The portable sink 20 further includes the gray water or second housing portion 38. The second housing portion 38 may house therein and/or include a second container that contains gray water in a gray water containment area or volume 82. The gray water containment volume 82 may be defined by the second or rear housing 38 alone and/or may be included in a separate container. Nevertheless, the second housing portion 38 may be provided with the portable sink 20 to capture water that is dispensed through the faucet 50 and captured in the basin 58, such as in the internal surface 62. Thus, the portable sink 20 may be substantially self-contained to include the clean water volume 66 that may be dispensed through the faucet 50 into the basin 58 and then captured in the gray water volume 82. After capture, the gray water may be emptied from the gray water volume 82 in any appropriate manner, such as through a gray water outlet 88.

The portable sink 20, therefore, allows for the portable sink 20 to be positioned in any appropriate location, regardless of a plumbing line and/or sewer line connection. The portable sink 20 is self-contained and may include a selected volume of clean water in the clean water volume 66 and include the gray water volume 82 to collect the water used for cleansing purposes by a selected user. The portable sink 20, therefore, does not require connections to a water source or water away structure as it includes internally both of the clean water source and the gray water collection volume.

Within the clean water area or volume 66, which may be within the first housing portion 34 or in a separate container for the clean water, may be a heating assembly 100, 500 as illustrated in FIGS. 2, 3, and 6-9. The heating assembly 100 may include various portions that allow for operation of a heater 124 within the clean water volume 66. Generally, the heater assembly 100 may include a pump assembly 104 that can include an appropriate pump 114, such as a sump pump that may be powered to draw water generally through one or more inlet ports 108 in the direction of arrow 112. The water may flow through the inlet port 108 due to pumping of pump 114 of the pump assembly 104.

The pump 114 may be an appropriate type of pump such as an submersible pump operable at an appropriate flow rate that may be powered with an appropriate power source, such as an internal battery 117, an external power source that may be connected to the portable sink 20, or other appropriate power source. The pump 114 may be a variable speed pump that may be controlled, as discussed herein. Further, the pump 114 may be an inline pump. In various embodiments, the pump 114 may be an impeller type pump with a flow rate of about 0.5 gallons per minute to about 5 gallons per minute, including about 1.1 gallons per minute. The pump 114 may further be self-priming, have a direct-current (DC) motor or an alternating current (AC) motor, and have a variable and/or selectable flow rate, such as to be controlled by the controlled based on selected parameters. In other words, the pump 114 and the heater 124 may operate to continuously heat water in the eater supply in a re-circulating or continuous manner during a selected operation cycle. The operation cycle may be maintained and/or determined with the selected controller system, as discussed herein.

The water, or selected fluid, may pass from the water volume, such as the volume 66, from the heater assembly 100, 500 via and through a line 115 to the faucet or spigot 50. The water may be pumped with the pump assembly, as discussed herein. Further, the line 115 may be heated. That is, additional thermal energy may be added to the fluid in the line 115 as it passes from the heater assembly to the spigot 50. The line 115 may be any appropriate line such as PTFE Heated Hose—Braided Polyester Cover sold by Heating Elements Plus—A Division of Protherm Industries, Inc having a place of business in Tennessee. This may allow and/or assist in ensuring a selected temperature of dispensed water and/or reduce or eliminate a possibility of freezing in the line 115 to the spigot 50. The line 115 may be controlled by the controller of the heating assembly 100, 500 and/or obtain power from or through heater assembly 100, 500.

Generally, the water may flow, due to force provided by the pump 114, to and/or through a housing or passage assembly 120 that may house the heater 124. The heater 124 may also be an appropriate heater, such as a 500-watt heater that is able to heat water that passes the heater 124. The heater 124 may also be provided to have a power rating of about 100 W to about 1000 W. The heater 124 may be an appropriate submersible heater that heats water. The passage assembly 120 may also have an outlet 128 such that water may leave the passage assembly 120 generally in the direction of arrow 134. In various embodiments, the heater 124 may include an EASYHEAT in-line heater sold by Emerson Electric Co. having a place of business at St. Louis, MO. The heater 124 may be powered with an appropriate power source, such as an internal battery, an external power source that may be connected to the portable sink 20, or other appropriate power source. The heater 124 may be a variable power heater that may be controlled, such as operated at a selected wattage that may be controlled by the controller 150.

Therefore, water may enter the inlet 108 generally in the direction of arrow 112 due to force provided by the pump 114 and flow along the passage 120 past the heater 124 and out the outlet 128. As the water passes the heater 124, the heater 124 may be powered to provide a selected amount of thermal energy to the water. The heater 124 may provide thermal energy to the water as it passes the heater 124 and is returned to the clean water volume 66 through the outlet 128.

The heater assembly 100 may be incorporated with a control assembly housing 140 that may house various control portions and/or power sources therein. In other words, in various embodiments, the heater assembly 124 with the passage assembly 120 with the pump assembly 104 may be provided as a single unit with the control housing 140. The heater assembly 100, therefore, may be single unit that may be placed in the portable sink 20. In various embodiments the housing 140 may be sealed, such as water tight, and/or be potted to enclose components placed therein.

It is further understood that a power source, such as via the plug 21, may be provided to a power supply within the control housing 140 to provide power to the various components, such as the pump 114 and the heater 124. For example, a power supply 144 may be connected to a power connection 146 form the plug 21 to provide appropriate power to each of the components, as discussed above and herein. A controller, also referred to as a control module, 150 may be provided and may include one or more processor modules and/or memory modules to execute instructions to operate the pump 114, the heater 124, and other components, as discussed further herein. For example, the pump 114 may be connected by a communication connection (e.g., trace, wire) 154 to the controller 150 and the heater 124 may be connected by a communication connection (e.g., trace, wire) 158 to the controller 150. The connections 154, 158 may be wired connections to provide a physical connection between the controller processor 150 and the respective components. It is further understood, however, that the connections 154, 158 may be wireless connections such that the controller module 150 may transmit a wireless signal to the respective components.

Further, a temperature sensor 160 is provided to sense a temperature exterior to the housing 140. In various embodiments, the temperature sensors 160 is in the heating system itself, such as internal or incorporates with the heater assembly 100 and would not be a separate component of the portable sink 20. The temperature sensor may be an appropriate type of sensor such as a J-type and/or a K-type thermocouple, including those generally known in the art. The temperature sensor 160 may be provided exterior to the housing and/or configured to sense a temperature exterior to the housing 140. In addition, the temperature sensor 160 may be positioned within the housing 140 and configured to determine a temperature of an environment exterior to the housing 140 when positioned in the housing 140. The temperature sensor 160 may transmit a signal that is received by the processor module 150 with a connection 164. Again, the connection 164 may be a wired or physical connection and/or may be a wireless connection to allow for transmission over a selected distance and/or area.

The heater assembly 100 may be positioned in an appropriate location within the clean water volume 66, as illustrated in FIG. 1. The heater assembly 100 may be positioned at a location that allows for movement of the water within the clean water volume 66 through the heater assembly 100 to ensure an appropriate or selected temperature of the water in the clean water volume 66. For example, the heater assembly 100 may be positioned near a base or bottom of the portable sink assembly 20 to ensure that the pump assembly 104 is positioned in a low or sump position within the clean water volume 66. In this position, the pump assembly 104 may access to the volume of water within the clean water volume 66, regardless of the level therein.

Therefore, the heating system 100 may be positioned in the clean water volume 66 of the portable sink 20, according to various embodiments. This may allow the heater assembly including the pump assembly portion 104 and the housing assembly 140 to be efficiently positioned within the portable sink 20 or any other appropriate sink assembly, for efficient movement of water relative to the heater 124 and/or operation thereof. Therefore, the heating system 100 may include the controller 150 to control the pump 114 and/or the heater 124 regardless of the positioning of the heating system 100.

The controller 150 which may be within the housing assembly 140, may control various portions of the heater and pump assembly, including the pump 114 and heater 124, as discussed further herein. In addition, the heating system 100 including the controller housing 140 may include one or more input and/or output to control various portion of the portable sink 20. In addition and/or alternatively thereto, the controller 150, may control various additional assemblies, such as valves and/or sensors. For example, the controller 150 may control various pumps, valves, and position or activation sensors for operation of various portions of the portable sink 20.

Figure 2:
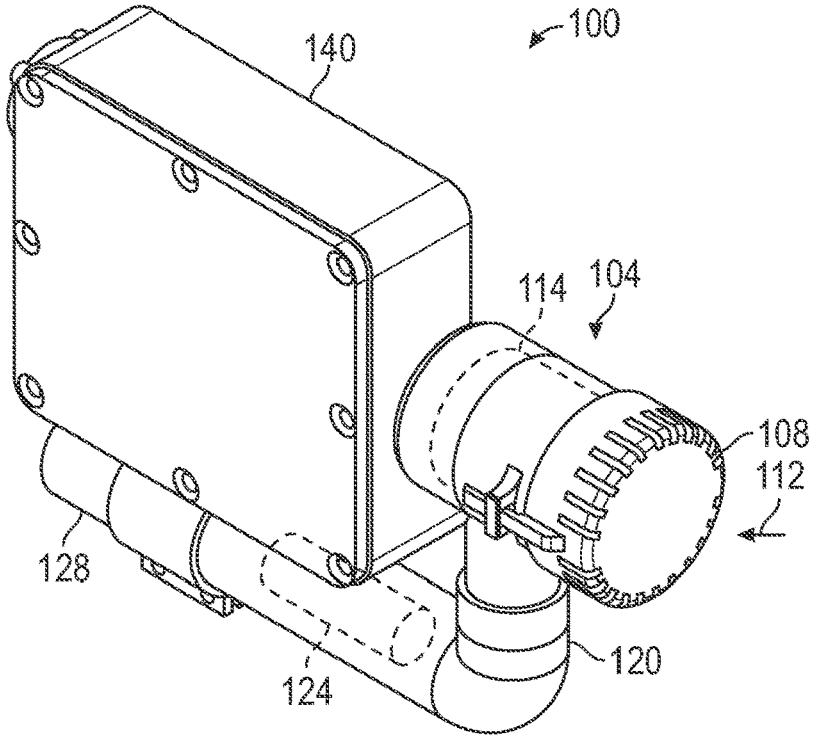
FIG. 2 is a schematic perspective view of a heater and controller assembly, according to various embodiments.
Figure 3:
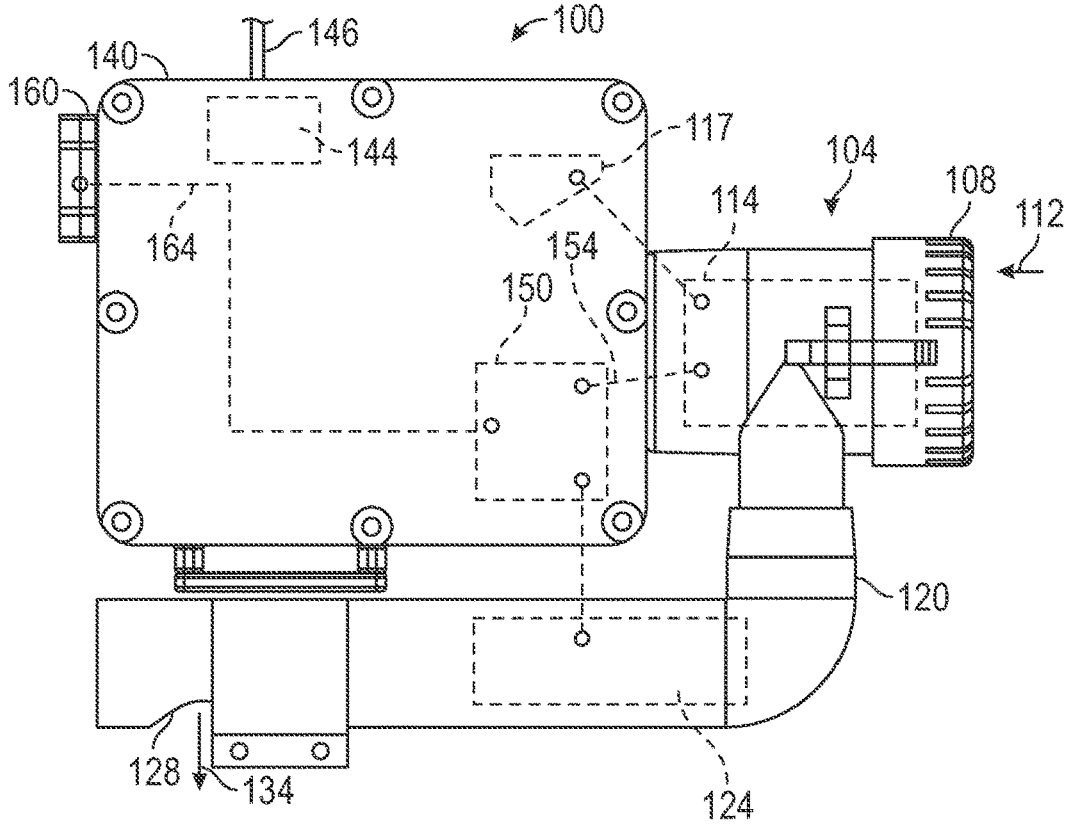
FIG. 3 is a schematic plan view of a heater and controller assembly, according to various embodiments.
Figure 4:
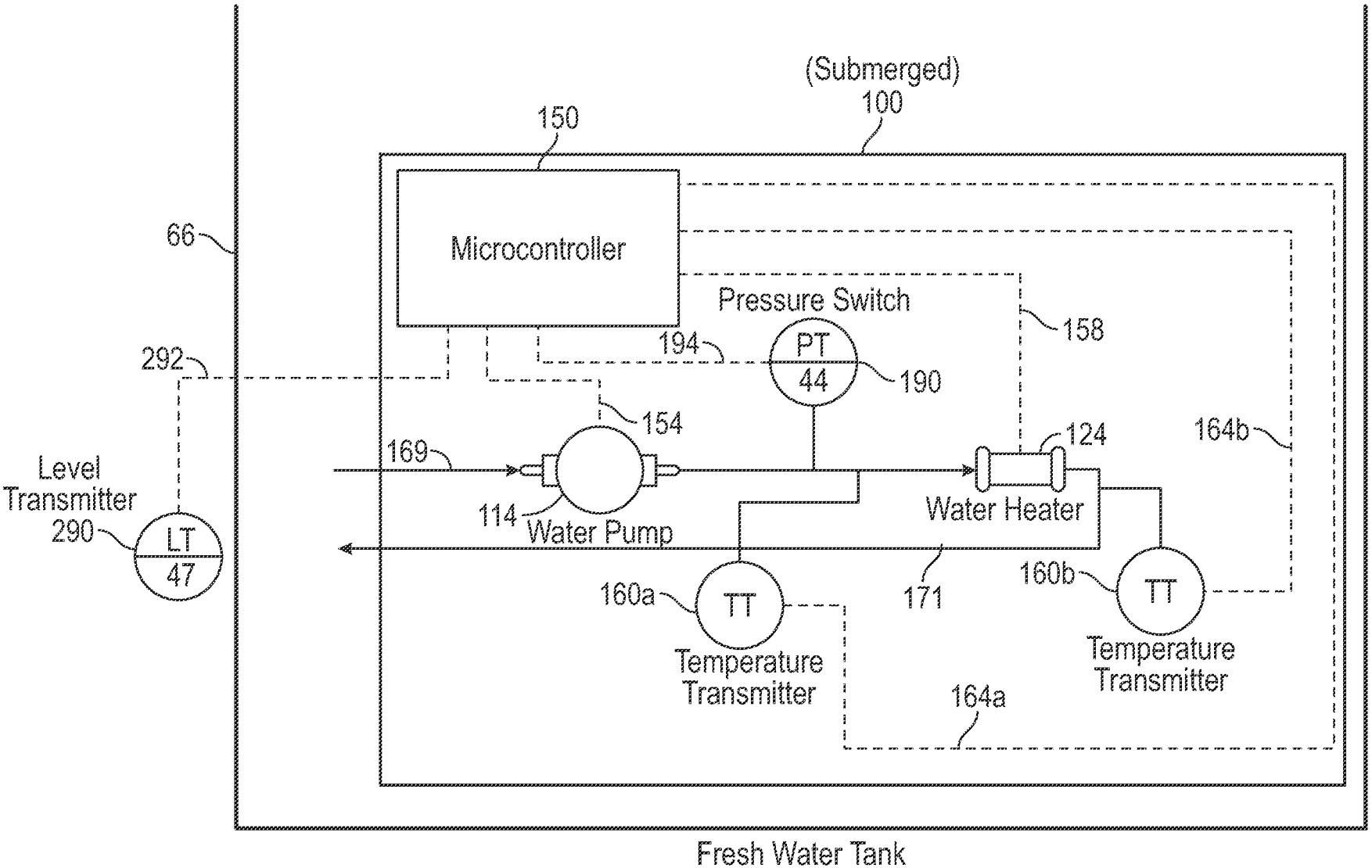
FIG. 4 is a Process and Instrumentation Diagram (P&ID) of the heater and controller assembly.

With continuing reference to FIGS. 1 through 3 and with additional reference to FIG. 4, a process and instrumentation diagram (P&ID) of the heater and controller assembly of the portable sink 20 is illustrated. As discussed above, the portable sink 20 may include the clean water tank volume 66 and the gray water volume 82. The selected volumes 66, 82, may be positioned in the portable sink 20 in any appropriate position, including those discussed above. Further, the portable sink 20 may include the faucet 50 that receives water or water passes through the faucet 50 after it passes through or past the heater 124 when directed by the pump 114. The water or selected fluid may pass from the water source through the heater assembly 100, 500 via the fluid communication line 115. The control module 150 may control operation of the heater 124 and the pump 114 to heat water. In various embodiments, the pump 114 may draw and/or push water along path 169 from the clean water tank 66 to the heater 124. Heated water may then be returned to the tank 66 via a return line 171.

The heater system 100, as noted above, may be positioned within the tank 66. For example, the heater system 100 may be submerged in water in the tank 66. Thus, various sensors may sense water levels and/or temperatures as discussed herein. Also, water may be drawn in and/or expelled from the heater system 100, as illustrated in FIG. 4, from and to the tank 66.

Additionally, the temperature sensor 160 may provide an input to the controller 150 to assist in operation of the heater 124 and/or the pump 114. In various embodiments, the temperature sensor 160 may include a first upstream temperature sensor 160*a* and a downstream temperature sensor 160*b*. Each of the temperature sensors 160*a*, 160*b* may provide respective sensed temperature signals 164*a*, 164*b* to the controller 150. The two temperature sensors 160*a*, 160*b* may assist the heater 124 to be operated more efficiently. Accordingly, the portable sink 20 may be used to provide water at a selected temperature to the faucet 50 to the sink basin 58. From the basin 58, the water may drain to the gray water tank 82.

Further, the system may include a selected valve that checks or controls water to the clean water tank 66 along path 171 after exiting the heater assembly or relative to the heater 124, as discussed above, when water is not directed to the faucet 50. Thus, the water in the clean water tank volume 66 may be maintained at a selected temperature, as discussed further herein, while only can be provided to the faucet 50, when selected. As discussed herein, the heating system 100 provides a circulating or re-circulating water heating system to and from the tank 66 until a portion is moved through the faucet 50. The water in the volume 66 may be maintained at a selected temperature and moved within the volume 66.

In addition, a level sensor 290 may provide a level indication or signal to the controller 150 through the connection 292 to determine a level within the clean water tank volume 66. With the level sensor signal the controller 150 may know or record a level within the clean water tank 66. In various embodiments, the heating assembly 100 may operate when only a selected water level is present in the tank 66 and/or transmit a signal regarding the water level. For example, if the level of water is below a selected level (e.g., 0.5 liters) as sensed by the level sensor 290 the controller may cease and/or not initiate operation of the pump 114 and/or the heater 124.

The portable sink 20 may further include a pressure sensor and/or switch 190 that may transmit a pressure signal via a connection 194 to the controller 150 based on a sensed pressure. The pressure sensed may be between the pump 114 and the heater 124. The pressure sensor 190 may be used to assist in controlling operation of the pump 114 and/or the heater 124. For example, the pressure sensor 190 may be used to ensure that an appropriate pressure is at the outlet of the pump 114 and assist in assessing operation (e.g., blockage) of the pump 114. If the pressure is not great enough, the pump 114 may be stopped and/or operation thereof may not be initiated.

Accordingly, the portable sink 20 may include various portions that allow for operation of the heater 124 to select a temperature of water within the clean water volume 66. The temperature sensor 160 may assist in providing a signal to the controller 150 to control operation of the pump 114 and the heater 124 to assist and maintain the selected water volume 66, as discussed further herein, at a selected or set temperature. Thus, the portable sink 20 may include the clean water volume 66 maintained at the selected temperature. The clean water volume 66, therefore, may be provided to assist in cleaning and maintaining a cleanliness of the user while the water is maintained at a selected temperature. Moreover, the selected temperature may assist in ensuring that the portable sink 20 may be positioned substantially in any environment, such as an environment including a temperature below the freezing temperature of water, while maintaining the water in the clean water volume 66 in a liquid state. Moreover, the temperature of the water in the clean water volume 66 may be maintained at a selected cleaning temperature, such as about 25° C. to about 40° C., including at or above about 40° C.

The portable sink 20, therefore, may be controlled with the controller assembly 140, including control module 150. The control module 150 may execute a selected instructions stored on a memory included with and/or access by the control module 150 to operate the portable sink 20 in a selected manner. Thus, the portable sink 20 would be operated based upon operation of the controller 150 that may be altered based upon instructions provided to the controller 150 and selected for operation by a selected user.

The control module 150 may include a selected processor assembly, such as that discussed above and further herein. The control module 150 may perform various functions, such as executing selected instructions included in software to allow for operation of various portions of the portable sink 20, such as the pump 114 and the heater 124. According to various embodiments, with reference to FIG. 6, the control module 150 may operate the heater 124 and the pump 114 to achieve a selected temperature within the clean water volume 66 of the portable sink 20.

Figure 5:
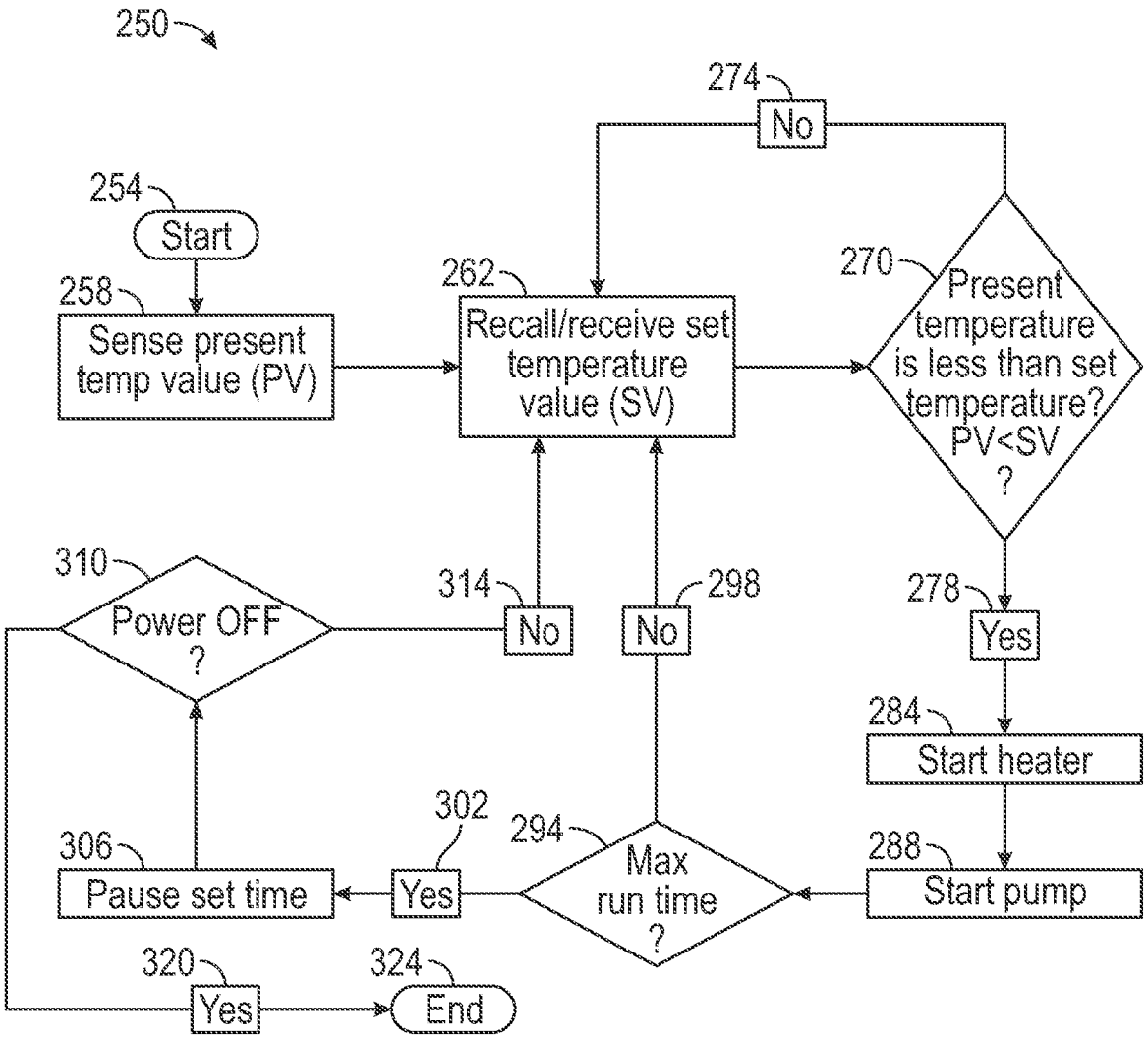
FIG. 5 is a flow chart of an operation of a portable sink with a heater assembly and a controller assembly, according to various embodiments.

The control module 150 may operate according to a process 250, as illustrated in FIG. 5. The process 250 may include executing of instructions included in a program and/or based on a design of the control module 150 including by one or more processors therein. The software may be stored with the control module 150 and/or accessed through an appropriate network.

The process 250 may start in block 254 which may include powering on of the portable sink 20. Powering on of the portable sink 20 (herein discussion of the sink 20 is understood to include a sink according to any disclosed embodiments) may include connecting or plugging in the portable sink 20 with an appropriate connection, such as the connector 21, to an appropriate power source. Further, the portable sink 20 may include a switch that may be a physical switch and/or a transmission of instruction to the controller 150. Nevertheless, the controller 150 may operate according to the processor 250 to operate the heater 124 and the pump 114.

Initially, the temperature sensor 160 may sense the temperature of water within the clean water volume 66. As discussed above, the temperature sensor 160 may be positioned within the clean water volume 66 to sense the temperature of the water therein. In various embodiments, as discussed above, the assembly 100 may be provided in the clean water tank such that the temperature sensor 160 is in contact with the selected portion of the clean water volume. Therefore, the temperature sensor 160 may sense the temperature of the clean water volume (e.g., the present temperature value) and may transmit a signal to the controller to sense the temperature in block 258.

A set temperature may be recalled or received in block 262. The set temperature may be based upon a preprogrammed or pre-determined temperature and/or one received from a user, such as an installer of the portable sink 20. Therefore, the controller 150 may operate the system to operate at a selected temperature of the clean water volume 66 that may be altered by the user based upon various positions, applications, and the like. For example, the user may set the temperature at 40° C. to maintain the temperature in the clean water volume 66 at a selected set temperature. The temperature, however, may also be set at any appropriate temperature, such as about 1° C. and or any appropriate upper temperature limit, such as about 90° C. In various embodiments, for example, maintaining the clean water at a non-freezing state may be selected to reduce energy usage, but ensure that the water within the clean water volume 66 remains liquid. In other situations, the temperature may be set to include the water in the clean water volume 66 at a selected temperature for use thereof. Regardless, the set temperature may be recalled or received in block 262 and/or may be altered or selected by a user during use and/or after installation of the portable sink 20. It is understood, however, that the set temperature may be preprogrammed or preset and that the controller 150 includes accessing a select temperature to which the sensed temperature from block 258 may be compared.

Accordingly, the set temperature may be compared to determine whether the sensed temperature is at a selected temperature relative to the set temperature in block 270, such as less than the set temperature. The determination of whether the sensed temperature is less than the set temperature in block 270 may include a comparison of the sensed temperature to the set temperature, a calculation of the differential between the sensed temperature and the set temperature, or any other appropriate determination. For example, the determination of whether the sensed temperature is less than the set temperature may include that a determination that the sensed temperature is greater than 1° less than the set temperature. In various embodiments, a controller, as discussed herein may be used to maintain the selected temperature. This controller may include a proportional-integral-derivative controller (PID).

If the determination is made that the sensed temperature is NOT less than the set temperature a NO path 274 may be followed to continue to recall and/or receive the present temperature in block 262 to determine whether the sensed temperature has changed relative to the set temperature. Therefore, the controller 150 via the sensor 160 may continually determine whether the sensed temperature is less than the set temperature in block 270.

If the sensed temperature is less than the set temperature a YES path 278 may be followed. If following the YES path 278, the controller 150 may start the heater in block 284 and start the pump in block 288. It is understood that starting the heater 284 and starting the pump 288 may occur in any appropriate order, and that starting the heater in block 284 may precede starting the pump in block 288 and/or vice versa. Further, the controller 150 may simultaneously or substantially simultaneously start the pump and heater in blocks 284, 288.

In addition, the pump 114 and of the heater 124 may be operated in a variable manner, as discussed above. For example, the controller 150 may determine that the differential between the set temperature and the present temperature (e.g., greater than 5°) may be great enough to operate the heater at a high wattage (e.g., greater than 1000 W). At a selected differential that is less (e.g., 1°) the heater 114 may be operated at a lower wattage (e.g., 500 W). Similarly, the pump 114 be operated at different selected speeds based upon the differential temperature or other appropriate operating parameters. Therefore, starting the heater 124 in block 284 and starting the pump 114 in block 288 includes operating each of the heater 124 and/or the pump 114 at selected speeds and/or powers.

After starting each, the pump 114 and heater 124 may be operated in a selected manner to increase temperature of the water in the clean water volume 66. In various embodiments, for example, the controller 150 may set a power of the heater 124 and speed of the pump 114 to set a rate of increase in temperature of the water within the clean water volume 66, maintaining a temperature of the water in the clean water volume 66, or other appropriate conditions. In addition, to the PID controller the control system may further include a triode for alternating current (TRIAC).

After operation or starting of the heater 124 in block 284 and the pump 114 in block 288, a max run time may be determined in block 294. A max run time may be any appropriate run time and may be based on operation of the heater and/or the pump. If a max run time has been determined to not have been reached a NO path 298 may be followed to recall and/or receive the present temperature in block 262. The temperature may be compared again in block 270 and a determination of whether the temperature is less than the set temperature be determined. This allows a continuation of operation of the heater and/or pump in blocks 284, 288. Therefore, the controller 150 may operate to continue operation of the heater and the pump until the set temperature has been achieved and/or a max run time has been met.

Accordingly, if a max run time is determined to have been met, a YES path 302 may be followed for a set pause time in block 306. The pause time may be any appropriate time, such as to allow a cool down of the heater 124, a cool down of the pump 114, or other appropriate considerations. It is understood that a max run time may not be met due to the immersion of the heater 124 and the pump 114 in the water volume in the clean water volume 66, however a selected max time may still be provided.

After a set pause time has passed per block 306, a determination of whether the system has been powered off is made in block 310. If the system has not been powered off, a NO path 314 may be followed to the recall and/or receive the present temperature in block 262. Accordingly, while the system of the portable sink 20 is powered on, the controller 150 may sense the temperature of the clean water volume 66 and operate the heater 124 and/or the pump 114 to attempt to achieve and maintain the set temperature recalled in block 262. Thus, the controller 150 may operate in a substantially continuous loop while it is powered on.

When the system is powered off or determined to be powered off in block 314, a YES path 320 may be followed to end operation in block 324. Thus, the controller 150 may operate the heater 124 and the pump 114 according to the process 250, as discussed above, to achieve and maintain a temperature of the water in the clean water volume 66. A user may power on the system to begin operation of the controller 150 and portions of the portable sink 20 for maintaining or achieving the selected temperature of the water. At an appropriate time, however, the user may power off the system and allow for the portable sink 20 to be maintained, moved, or the like.

Thus, during operation the user may position the portable sink 20, 20' at a selected position and fill the clean water volume 66. The user may then power on the system to power on the controller 150 to begin operation of the heater 124 and/or the pump 114 within the portable sink 20. As discussed above, the controller 150 and various associated components may be positioned in any appropriate position relative to the clean water volume 66 while the heater 124 and the pump 114 positioned within the clean water volume 66. The pump 114 may then pump water past or relative to the heater 124 to allow for transfer of thermal energy from the heater 124 to the water volume the water in the water volume to achieve a selected temperature of the water therein. The user may determine a length of operation and/or maintenance of the portable sink 20 as is generally understood by one skilled in the art.

As discussed above, the sink assembly 20 may include the heating assembly 100. The heating assembly 100 may be incorporated into a substantially single unit, for example as illustrated in FIG. 2. According to various embodiments, however, various portions of the heating assembly 100 may also separately. For example, the pump and heater may be separated, but still controlled by the controller.

As discussed above, a heating assembly 100 may be included in a selected system or assembly, such as the portable sink 20, as illustrated in FIG. 1. The portable sink may include various portions such as the faucet or spigot assembly 50, the bowl 62, the clean water container (or any appropriate liquid) or volume 66, and other various components. As discussed above, the heater assembly 100 may be positioned in or adjacent to the clean water volume 66. The heater assembly 100 may be used to heat water in the clean water volume 66 for various purposes, such as to minimize or eliminate freezing of the water, providing water at a selected temperature to the spigot assembly 50, and other various reasons.

Figure 7:
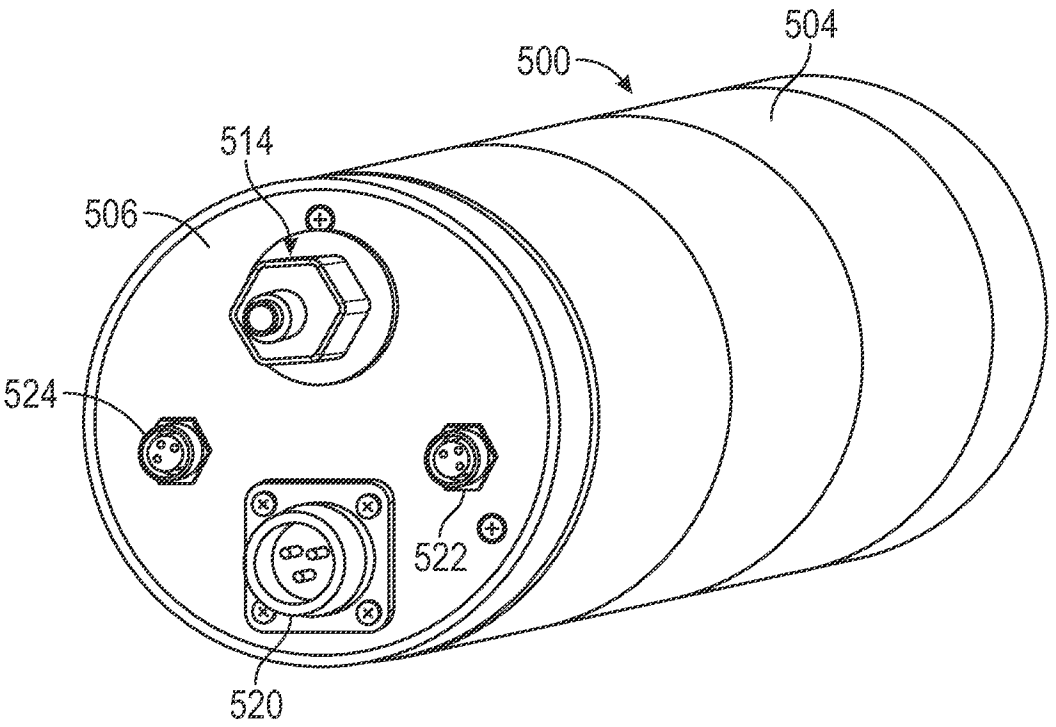
FIG. 7 is an end perspective view of the heater assembly, according to various embodiments.
Figure 6:
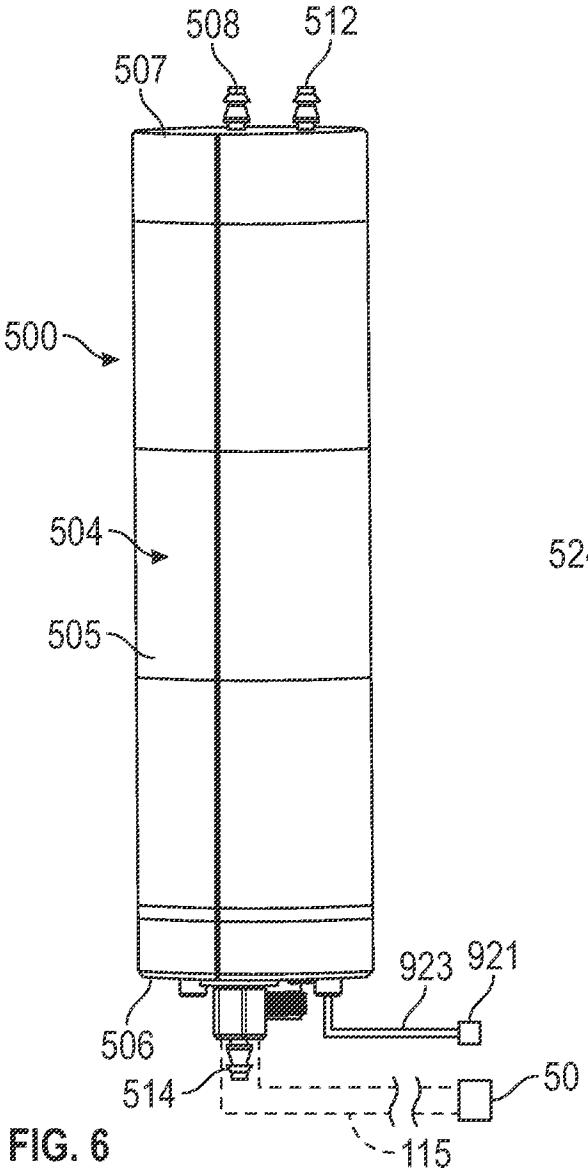
FIG. 6 is a side elevational view of a heater assembly, according to various embodiments.
Figure 8:
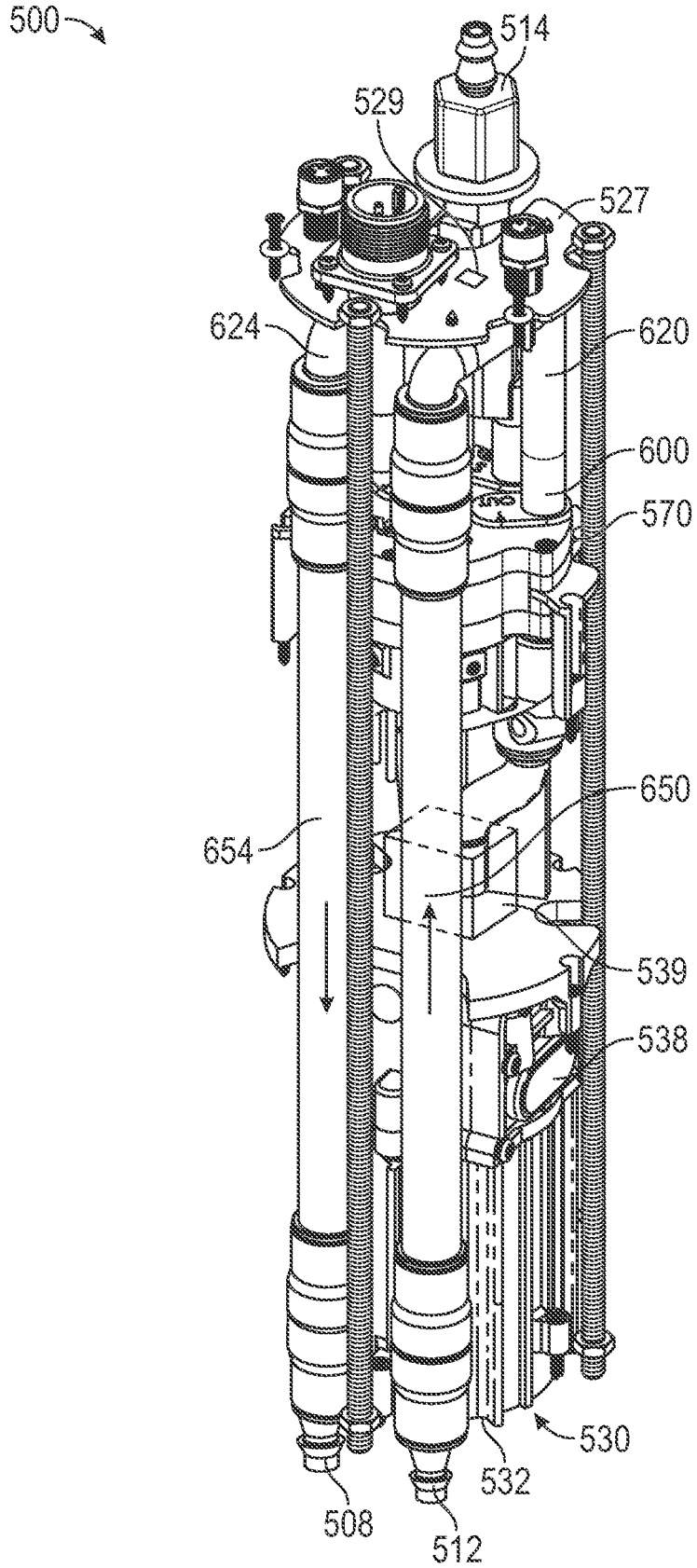
FIG. 8 is an end perspective view of the heater assembly with an outer housing removed.

According to various embodiments, the heater assembly may be provided in various configurations and with various components. For example, as illustrated in FIGS. 6 and 7, a heater assembly 500 is illustrated. The heater assembly 500 may include components similar or identical to those discussed above for the heater assembly 100. As discussed further herein, however, the heater assembly 500 may include components that are the same or different than the heater assembly 100. Nevertheless, the heater assembly 500 may be positioned in a selected assembly, such as the portable sink 20 or any other appropriate portion to perform various functions as discussed herein. Further, the heater assembly 500 includes various components that may be provided separate from the heater assembly 500 for similar operation that is notched with the portable sink 20. As discussed herein, in general, the heater assembly may be interchanged with the heater assembly 500 for operation and/or usage with a selected system, such as the portable sink 20.

The heater assembly 500 may include an exterior housing 504. The exterior heating assembly 504 may be provided as a single unit or as a plurality of units or modularly to be assembled around interior components. The exterior housing 504 may generally be at least water tight and/or may be hermetically sealed.

The housing 504 may include an exterior or cylindrical housing portion 505 and one or more end housing portions 506 and 507. The housing assembly 504 may then be held together with various assembly components such as connecting portions or assemblies 509 that include one or more externally threaded rods 511 and one or more internally threaded nuts 513. The connection assemblies 509 may provide selected structural integrity to the pump assembly 500. It is understood, however, that various other components may also be provided to assemble and/or provide structure to the heater assembly 500. The connecting rod assemblies or connections 509 may provided a selected tension on the housing portions 504 to provide the appropriate integrity and structural rigidity to the pump assembly 500.

The heater assembly 500 may include various electrical connections, communication connections, and/or fluid connections to and/or through one or more portions of the housing 504. For example, the heater assembly 500 may include a water outlet 508 and a water inlet 512. Further, the heater assembly 500 may include a second water outlet that may also be referred to as a spigot outlet 514. The water inlets and outlets 508, 512, 514 may be provided in any appropriate manner. For example, the water connections may include quick connected barbs that allow for selected or appropriate tubing or hoses to be slipped onto the barbs and held in place. Additional connections may also be provided. The connections may be provided to form watertight connections with selected tubing with a slip fit and/or with further connections such as hose clamps.

The heater assembly 500 may further include various electrical and/or communication connections. For example, a first or main connection 520 may be provided to provide power and communication external to an assembly, such as the portable sink. Various other connections such as the first control connection 522 and a second control connection 524 may also be provided to allow for delivery of signals from various sensors and/or controllers to components within the heater assembly 500. The various connections 522, 524 may also be provided to provide power to selected components that may be additional or auxiliary to the main power or signal connection 520.

As noted above, the heater assembly 500 may also include the housing 504. The housing 504 may house various components within the heater assembly 500. With additional reference to FIG. 8 and FIG. 9, the heater assembly 500 is illustrated with the housing 504 removed to expose the various internal components of the heater assembly. The heater assembly 500 includes various main components, such as a pump assembly 530 that may include a pump housing 532 and a pump motor 534. The pump motor 534 may be assembled to a pump valving housing 538. The pump assembly 530 may include any appropriate pump, such as a 3MD Series, sold by Boxer Pumps. The pump assembly 530 may be used to pump a selected fluid, such as water, through the heater assembly 500. The pump assembly 530, therefore, may be operated in any appropriate manner and may be controlled by various control signals such as those delivered or provided to the heater assembly 500 through the various connections, as discussed above.

The pump assembly may include a selected diaphragm pump. The pump assembly 530 may further be powered with any appropriate power source. As noted above, the sink 20 may include or have a connection to a main power. Further, the heater assembly may include or have a supplemental or second power source, such as a power storage system (e.g., a battery) 539. The battery 539 may be connected to the heater assembly to power any appropriate portion, such as the pump assembly 530 and/or any one of the controllers, motors, heaters, etc. Power may be directed from the battery to power any appropriate system at any appropriate time and according to any appropriate power transmission system.

The pump assembly 530 may include two fluid openings that are interconnected with various other components of the heater assembly 500. The fluid openings to the pump assembly 530 may be to the valve assembly portion 538 and may further include a connection to a first fluid passage 542 and a second fluid passage assembly 544. Each of the fluid passage portions 542, 544 may include a respective support portion 546, 548. Further, each of the fluid connection assemblies may include fluid passage portions 552, 554. Therefore, the fluid passage portions 552, 554 may be supported along a selected distance or area with a support portions 546, 548.

Thus, the pump assembly 530 may be positioned a selected distance from other portions as discussed further herein. The pump assembly 530 may be positioned in the appropriate position relative to other portions of the heater assembly 500. Further, while the heater assembly 500 is illustrated in a substantially cylindrical and unitary configuration, it is understood that the heater assembly may be provided in an appropriate configuration, such as for selected or different installation configurations. For example, the heater assembly 530 may be provided at an angle relative to other portions of the heater assembly such that the heater assembly 500 may resemble an "L" shape, a "V" shape, a "U" shape, or any other appropriate shape. Nevertheless, the pump assembly 530 may provide a force or power to move fluid through the heater assembly 500, as discussed further herein.

The fluid connectors 542, 544 may be separate from and/or formed with other components of the heater assembly 500. For example, a mounting or fixture plate 560 may be formed with the fluid passages 542, 544 as a single member. It is understood, however, that either of the components may be performed separately and need not be formed as one component. Nevertheless, forming may include molding, printing (e.g., 3D printing), or other appropriate manufacturing techniques.

The fluid conduits 542, 544 may connect with the various portions of a valve assembly 570. In various embodiments, for example, a two-to-one or split connectors may interconnect the fluid passages 542, 544 with or more passages of the valve assembly 570. For example, a first push connector 574 may be provided to connect with the first fluid passage 542 having a first passage 576 that splits into two passages 578 and 580. Similarly, a fluid passage 584 that have a first connection 586 that splits to a first and second fluid connection 588, 590. This may allow the valve assembly 570 to selectively direct and/or allow for passage of fluid through the valve assembly 570 to and through the pump assembly 530 and in and out of the various connectors to the heater assembly 500, such as the connectors 508, 512 and 514. The valve assembly 570 may include various components and configurations, as discussed further herein.

Figure 10:
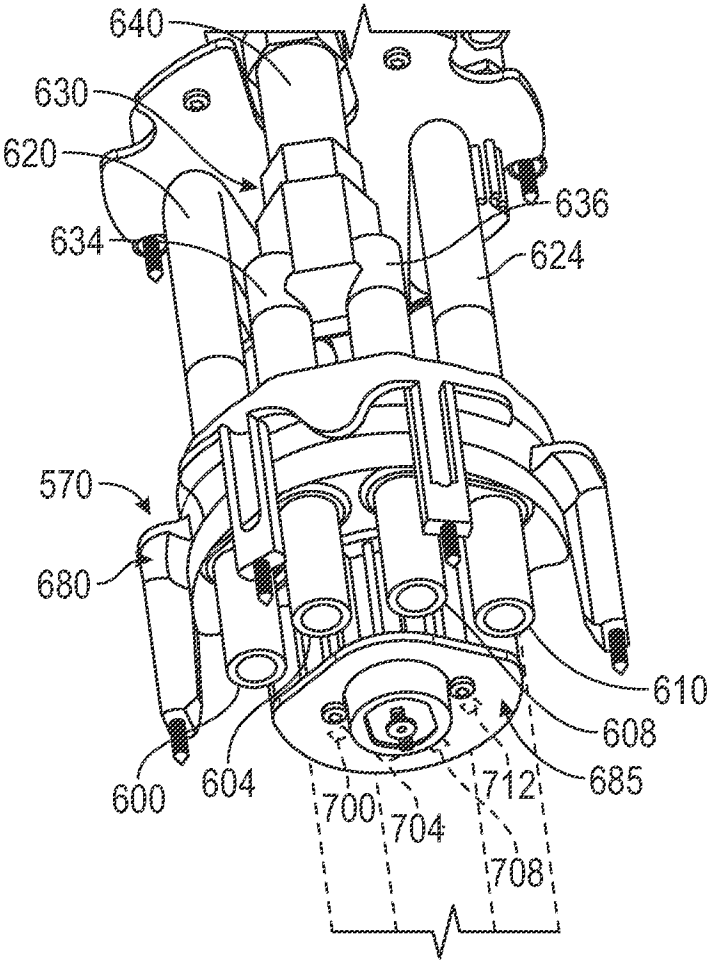
FIG. 10 is a first end perspective view of the valve assembly of the heater assembly, according to various embodiments.
Figure 13:
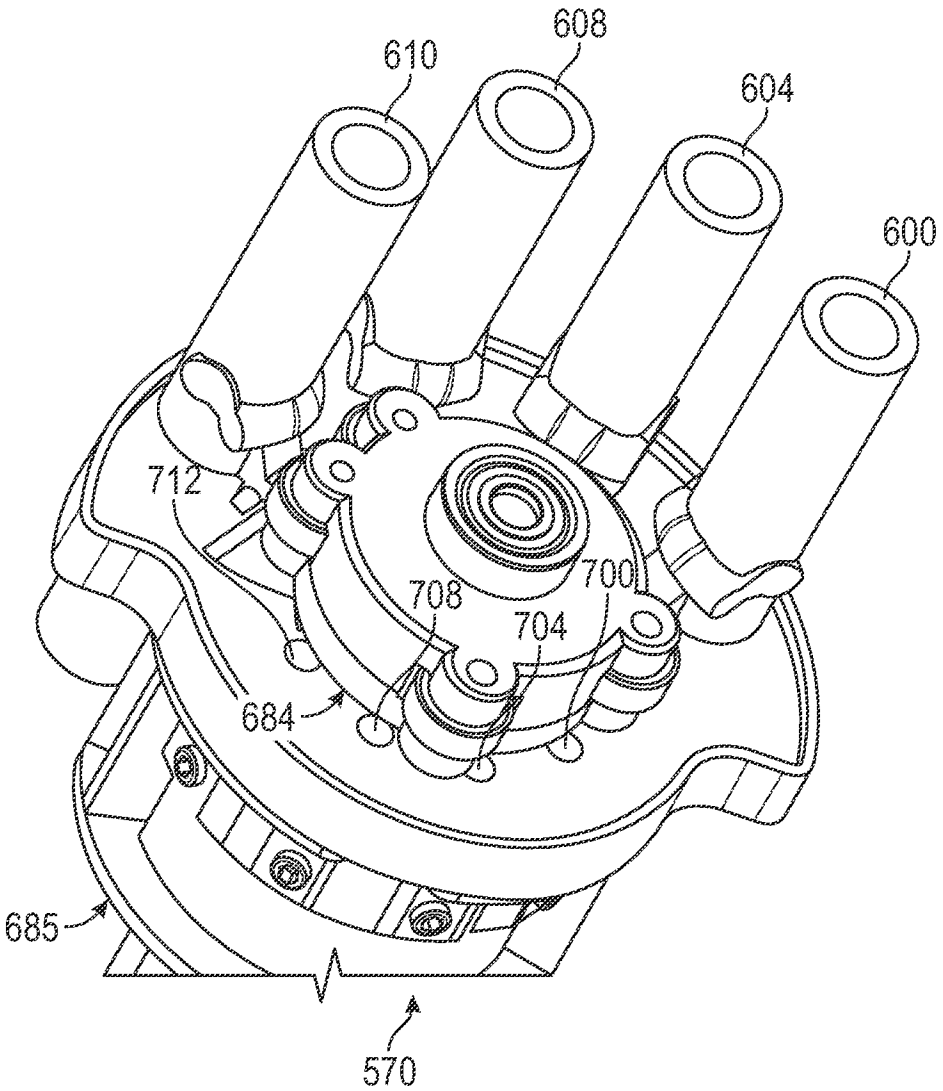
FIG. 13 is an end perspective view of the valve assembly, according to various embodiments.
Figure 12:
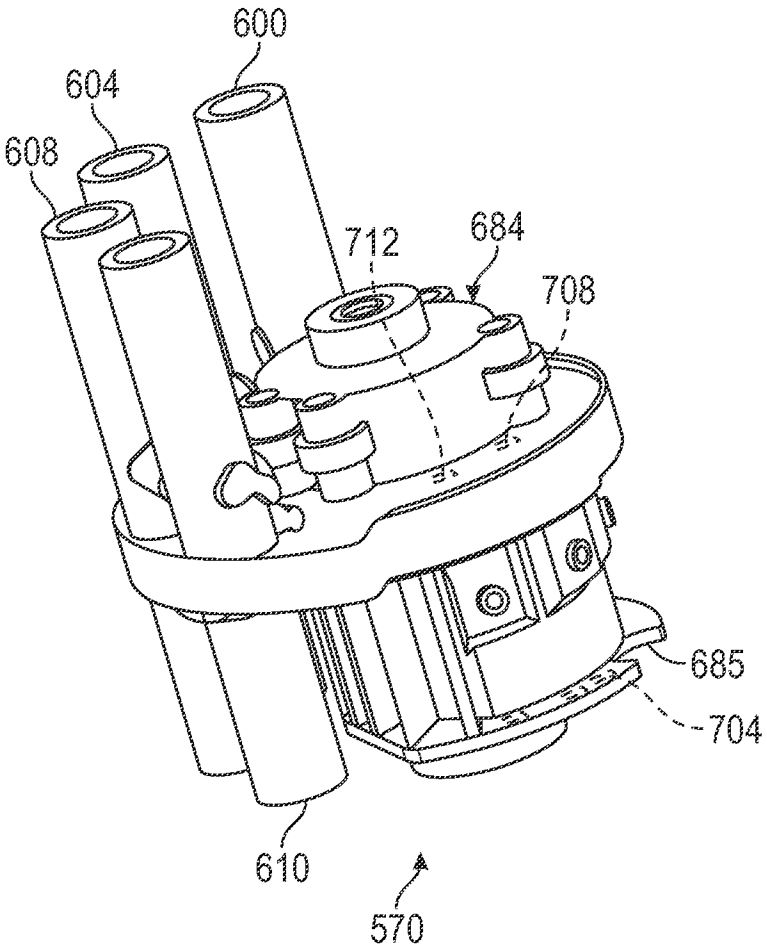
FIG. 12 is a partial exploded view of the valve assembly, according to various embodiments.
Figure 14:
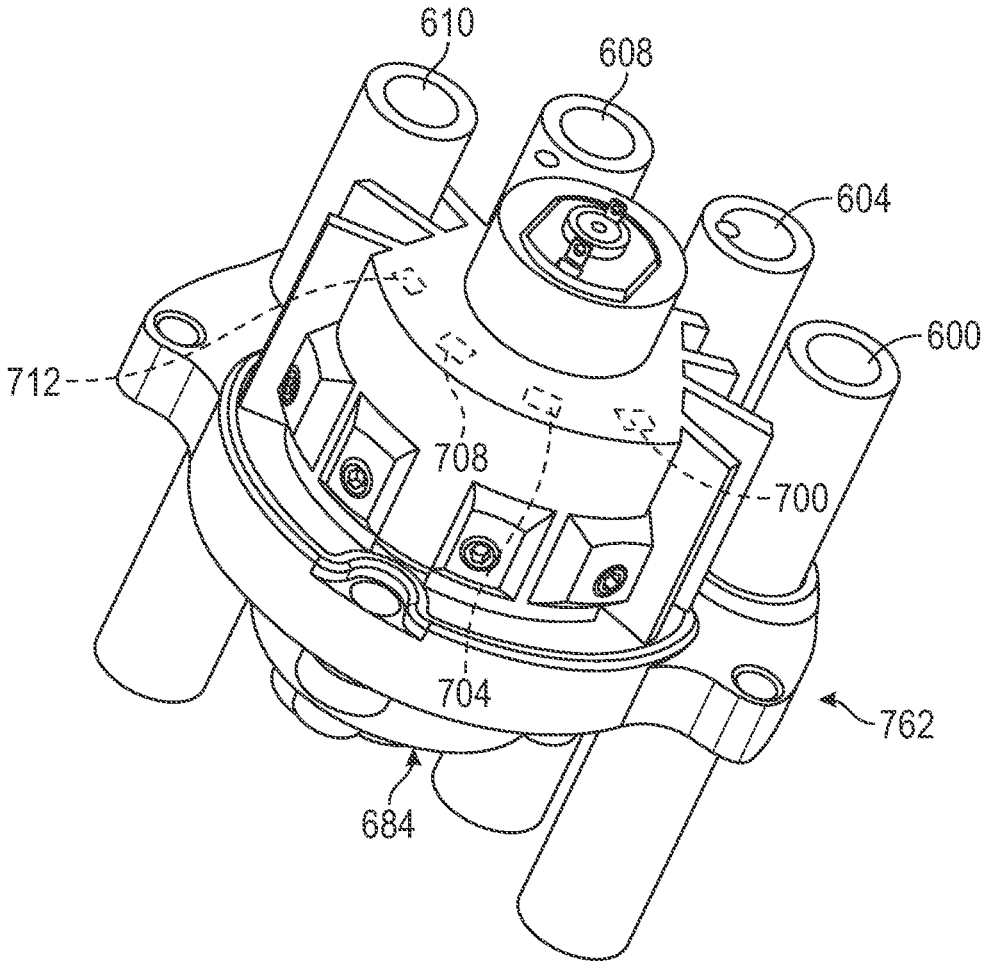
FIG. 14 is a partial exploded view of the valve assembly, according to various embodiments.

According to various embodiments, the valve assembly 570 may include an appropriate number of passages therethrough. The valve assembly 570 may be provided to control inlet and outlet of heater assembly 500, according to various embodiments as discussed further herein. The operation of the valve assembly 570 may be made according to various embodiments based upon operation thereof. Nevertheless, according to various embodiments such as those described herein, the valve assembly 570 may include four passages that may each include a tube 600, 604, 608 and 610 (FIG. 10).

The tubes 600, 604, 608 and 610 may be manipulated within the valve assembly 570 to control flow through the valve assembly 570 and, therefore, through the heater assembly 500. The tubes 600, 604, 608, 610 may be formed of any appropriate material and may include a selected hardness, such as a Shore A 35 such that they include a selected flexibility, including a resilient flexibility. As discussed further herein, the various tubes 600, 604, 608, 610 may be interconnected with the fluid splitter portions 574, 584 to the pump assembly 530 and further through various other connections to the spigot connector 514 and/or other passage assemblies.

The tube 600 may be interconnected with a variable passage portion 620. The variable passage portion 620 may be a passage from the tube 600 and/or may include various other components. For example, the variable passage 620 may include a sterilization or sanitation assembly. The sterilization or sanitation assembly may be included in the variable tube assembly 620 as an ultraviolet (UV) light source. The UV light source may be powered to provide a sterilization or sanitation to fluid, such as water, flowing through the variable tube assembly 620. Similarly, a variable tube assembly 624 may be interconnected with the tube 610. The variable tube assembly 624 may be identical, save for position, to the variable tube assembly 620. The UV sanitation assembly may include a PearlAqua Micro, sold by AquiSense.

Various other tubes may include a splitter or divider 630. The divider 630 may include first and second connections 634, 636 that may converge to a single connection or passage 640. The single passage 640 may interconnect with the spigot connector 514. Therefore, the valve assembly 570 may allow for interconnection of the spigot connector 514 and various other components, such as through the variable tube or sanitization portion 620, 624.

The valve assembly 570 through the appropriate tubes, such as the tubes 600, 610, may allow for passage or flowing of fluid through one or more heater assemblies. A first heater assembly 650 may be interconnected with the fist tube 600 with the first variable connection or UV sanitization assembly 620 therebetween. A second heater assembly 654 may be interconnected with the fourth tube 610 also through the second variable or UV sanitization assembly 624. The heater assembly 650, 654 may interconnect with the respective sanitization 620, 624 from the valve assemblies 570.

Figure 9:
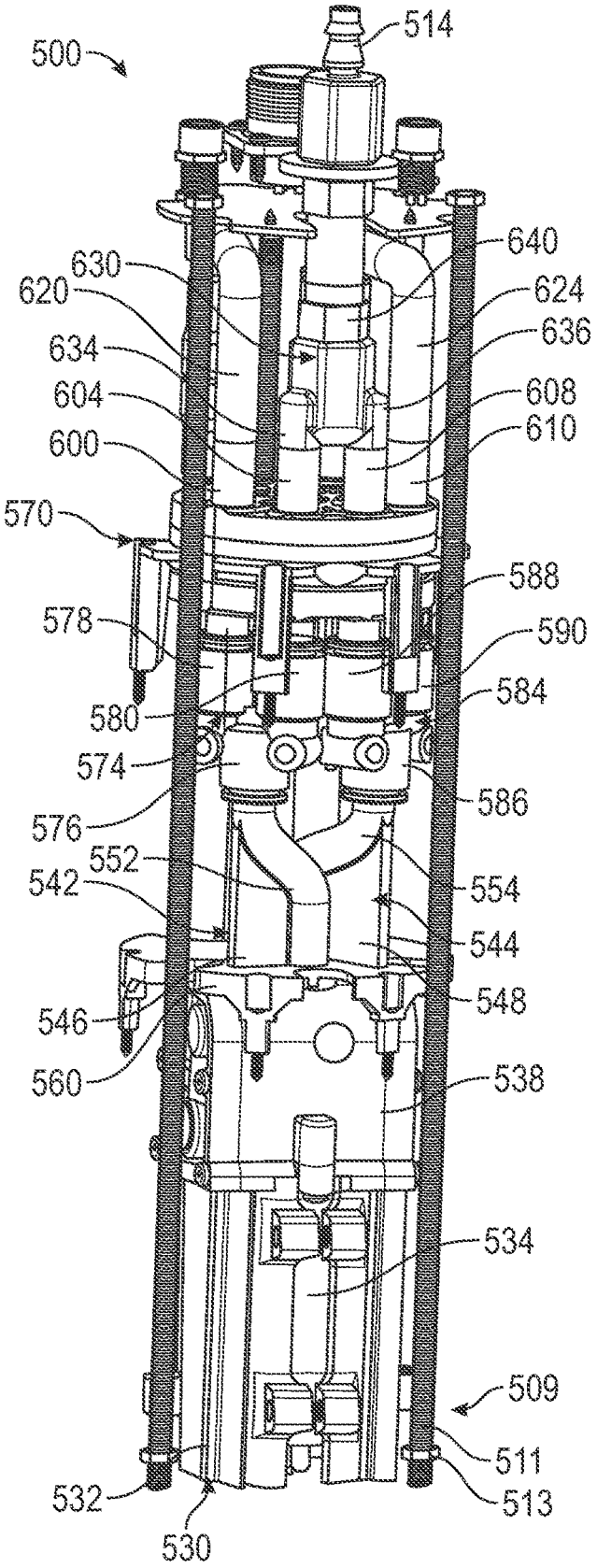
FIG. 9 is side elevational view of the heater assembly with the housing removed.
Figure 9A:
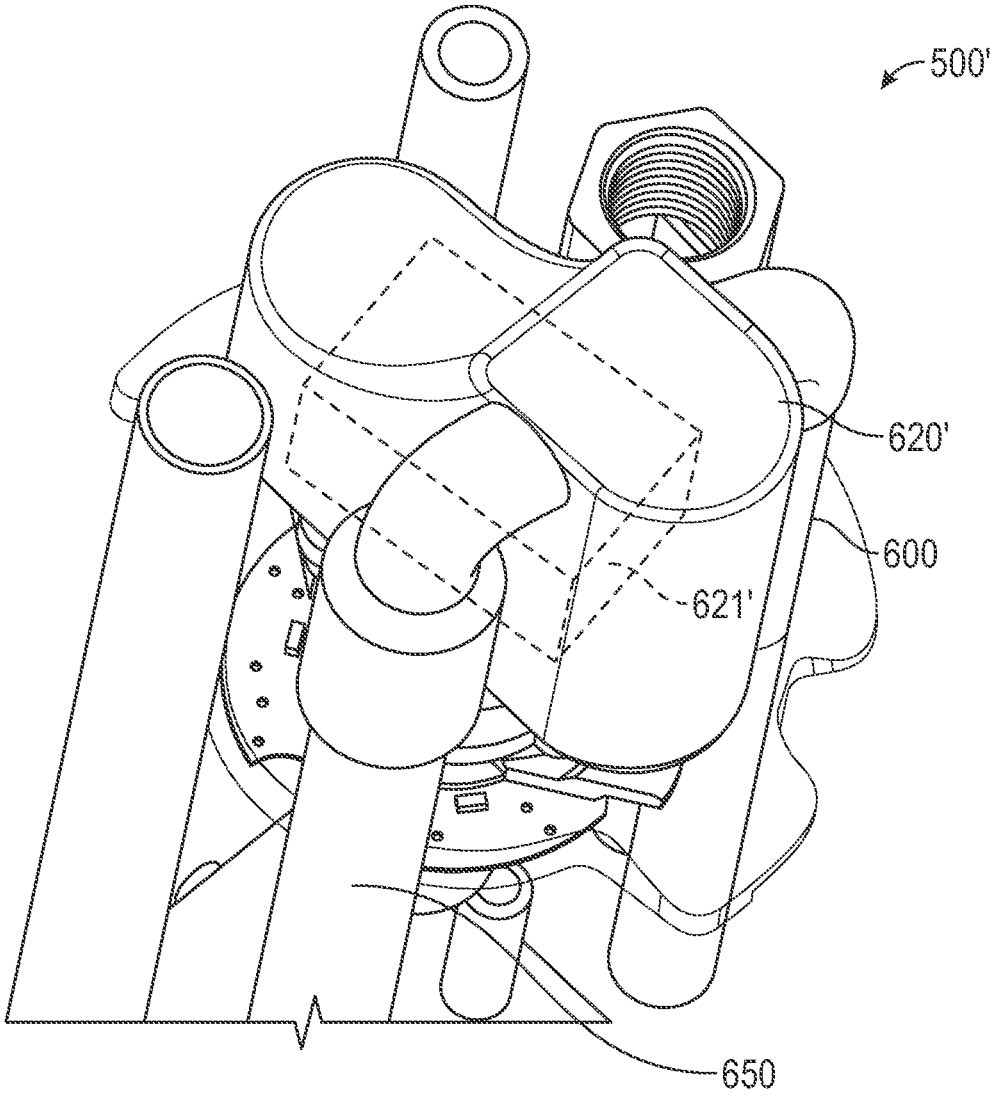
FIG. 9A is detail side elevational view of the heater assembly with the housing removed.

According to various embodiments, as illustrated in FIG. 9A, a UC sterilization or sanitation system 620' may be provided in a heater 500'. The heater assembly may otherwise be identical to the heater assembly 500. The UV system 620' may fluidly interconnect the inlet heater 650 and the tube 600. Thus, as fluid, such as water, is drawn into the heater assembly 500' the water may be subjected to UV radiation, such as from a UV radiation unit 621'. The UV radiation unit may be any appropriate unit, such as those noted above. Thus, the UV system 621' may be provided within a single unit and/or on only one direction of flow (e.g., inflow), according to various embodiments. Further, the fluid may not be subjected to UV radiation during an outflow from the heater system 500', according to various embodiments. The connection of the tube 610 and the heater system 654 may be only a fluid connection, such as a polymer pipe.

The pump assembly 530 may provide pressure and/or suction through the respective heater assemblies 650, 654 to provide a heating or thermal energy to the fluid flowing therethrough, such as the water from the clean water volume 66 as discussed above. According to various embodiments, for example, the first heater assembly 650 may be interconnected with the connector 512 that may provide a flow from the fluid volume 66. The second heater 654 may be connected with the second connector 508 that provides a fluid flow to the volume 66. According to various embodiments, therefore, the heater assembly 500 may allow for a flow to and from the fluid volume 66 through the respective heaters 650, 654. It is understood that the pump assembly 530 may be connected through the valve assembly 570 to the heater assemblies 650, 654. The flow direction may be selected for any appropriate purpose, and the exemplary embodiments illustrated herein are merely exemplary for the system exemplary being described herein. Further, it is understood that fewer than two or more than two of the heater assemblies may be provided. Two of the heater assemblies is merely exemplary.

The heater assembly 650, 654 may be provided in the heater assembly 500 to heat a volume of fluid as it flows through the respective heater assembly 650, 654. The heater assembly 650, 654 may therefore define an internal passage through which fluid such as water, may flow. A thermal energy may be provided to the fluid as it passes through the heater 650, 654. The flow rate through the heaters may be provided (e.g., by a selected pressure from the pump assembly 530) to ensure an appropriate heating of the water and/or a power from the heater 650, 654 may be altered to ensure a selected heating of the water. As discussed above and understood by one skilled in the art, the temperature of the water and the volume 66 may be selected for various purposes, such as to ensure not freezing thereof, a selected temperature for providing through the spigot assembly 50, effective cleaning or sterilization thereof (e.g., with the sterilization or cleaning assemblies 620, 624) or other appropriate purposes. The heater 650, 654 may, therefore, include any appropriate heating system. The heaters 650, 654, according to various embodiments, may include thermally conductive piping, such as copper, surrounded or inclusive of a resistive heating element such as Thickfilm Heater sold by Gida Heating Innovation.

The heater assembly 500, therefore, may include the various components as discussed above. The various components may included to provide a selected water pressure to the spigot assembly 50, a selected temperature of the water in the volume 66, a selected sanitization or sterilization of the water in the volume 66 and/or through the spigot 50, or other appropriate purposes. Generally, the pump assembly 530 may provide a selected flow of water to and from the heater assembly 500, the volume 66, and the spigot 50. According to various embodiments, the heater assembly 500 may be provided to heat the water and the volume 66, self-drain the heater assembly 500 under various conditions, and selectively provide water to the spigot assembly 50. Various operations may be controlled by various control portions, such as those discussed above and herein, including by operation of the valve assembly 570. The valve assembly 570 may provide limited or restrictive flow through one or more of the passage tubes 600, 604, 608, and 610 to ensure a selected flow to and/or from any of the selected components such as the volume 66, the heater assembly 500, and/or the spigot assembly 50.

Figure 11:
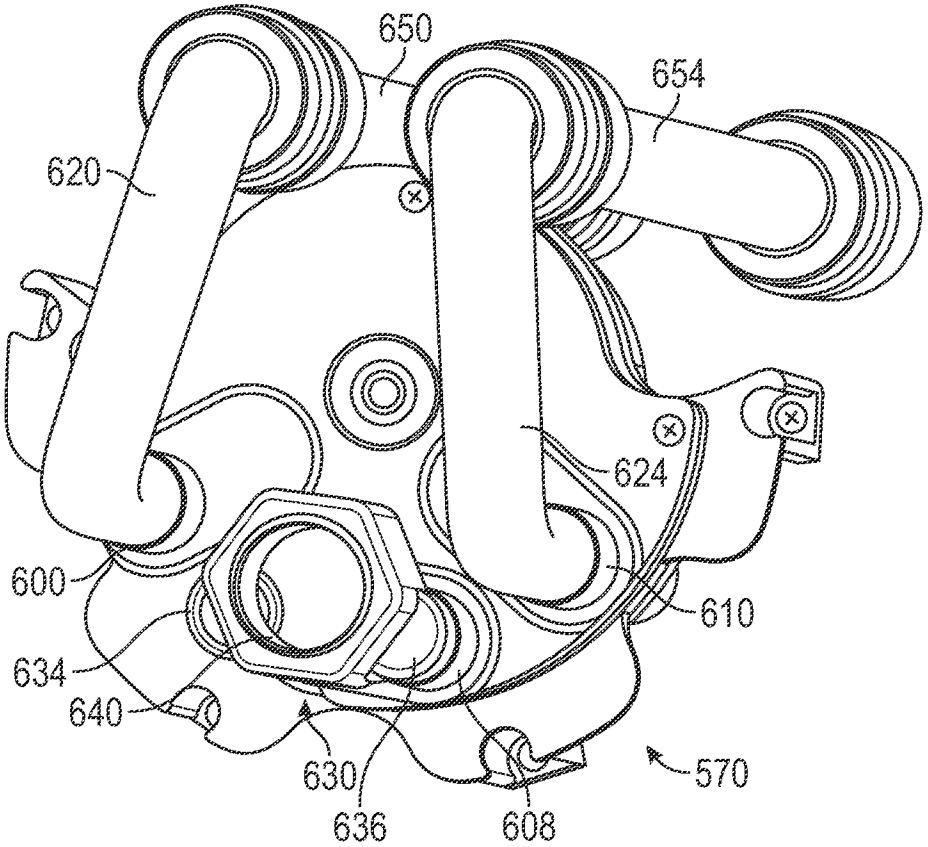
FIG. 11 is a second end view of the valve assembly of the heater assembly, according to various embodiments.

With additional reference to FIG. 10 and FIG. 11, the valve assembly 570 includes the various components, as discussed above, and those discussed further herein. The valve assembly 570 allows for open passage and/or restricted or closed passage through one or more of the several passages 600, 604, 608, and 610. The valve assembly 570 may at least include an exterior casing or housing 680 that houses various components, as discussed further herein, and may also provide selected structural rigidity to the heater assembly 500. The various connectors, such as the assembly connectors 509 may pass through and/or adjacent to the housing 680 of the valve assembly 570. The housing 680 may hold various components and allow for movement of various components, such as a valve actuator 684. The valve assembly 570 may further include a control system that may be included on a circuit board 684 (e.g., printed circuit board) that allows for positioning of various electronic components and/or can communication therebetween.

Figure 15:
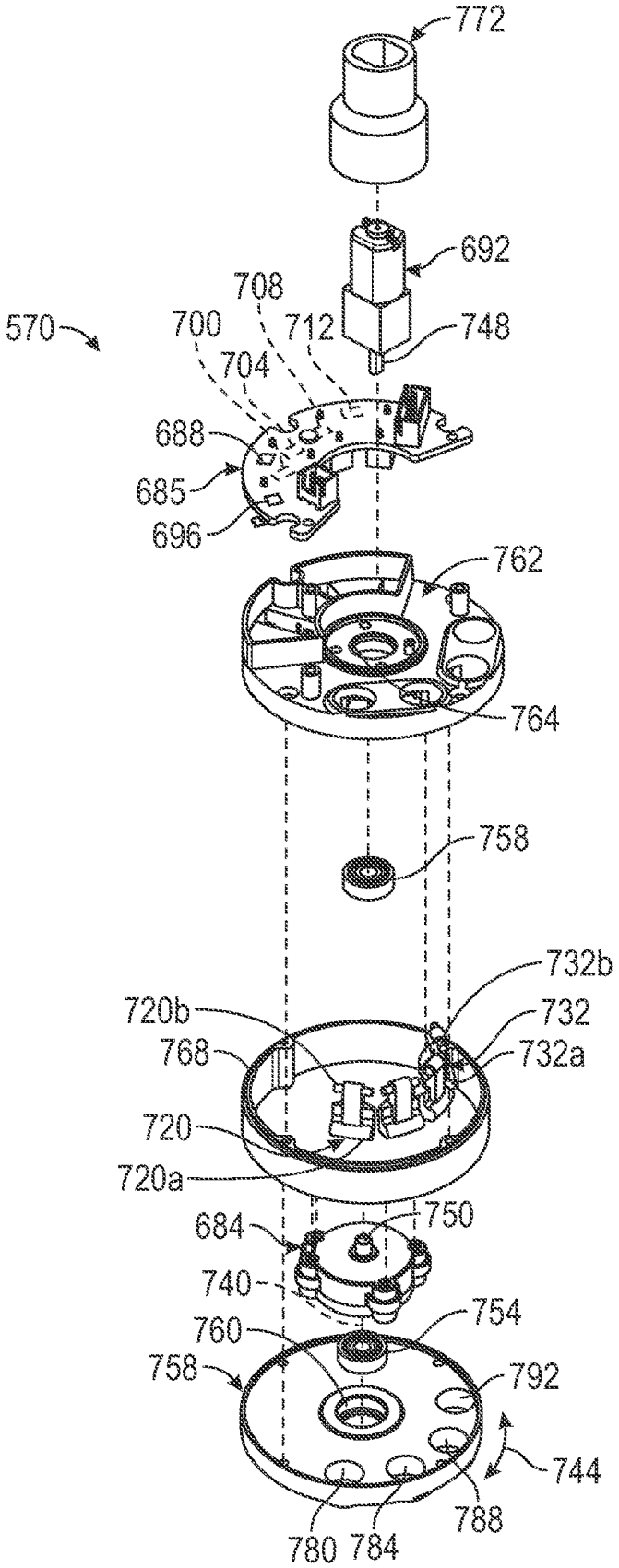
FIG. 15 is a top perspective exploded view of the valve assembly, according to various embodiments.

As discussed herein, a processor assembly 688 (FIG. 15) may be provided on the circuit board 684. The processor module 688 may be provided and/or programmed for control of various components, such as a motor 692 to move with various portions, such as the actuator 684. The processor module 688 may include a memory and/or access a memory 696 for various control schemes or programs, as discussed further herein. Therefore, the circuit board 684 may be provided at any appropriate portion of the valve assembly 570 to allow for control based upon selected input, accessed instructions, and/or programs for operation of the valve assembly 570.

The valve assembly 570, according to various embodiments, may include one or more proximity sensors, such as a first proximity sensor 700, a second proximity sensor 704, a third proximity sensor 708, and a fourth proximity sensor 712. It is understood that the proximity sensors 700, 704, 708, 712 may extend or be selectively connected to the board 685 to interact or sense selected portions of the actuator 684. For example, the proximity sensors may be provided to send a signal to the board 695 and/or to the processor 688 based upon sensing a portion of the actuator 684 near one or more portions of the proximity sensors 700, 704, 708, 712. As discussed herein, therefore, the board 685 may communicate a sensed position of the actuator 684, such as via the proximity sensors 700-712, to the processor 688 to operate the motor assembly 692 to move the actuator 694 to a selected position to operate the valve assembly 570, as discussed herein.

The proximity sensors, therefore, may sense a position of the actuator 694. The position of the actuator 694 may operate one or more valve arms or squeeze arms 720, 724, 728, and 732. Accordingly, in various embodiments the valve assembly 570 may be referred to as a squeeze valve. Again, it is understood by one skilled in the art that any appropriate number of the squeeze arms 720-732 may be provided and that only four squeeze arms are illustrated for an exemplary embodiment. Various numbers of these squeeze arms may be provided and the actuator assembly 694 may operate or actuate them as selected based upon a selected program or operation of the valve assembly 570. The four squeeze arms 720-732 are exemplarily illustrated relative to the four tubes 600-610, according to various embodiments.

The squeeze arms 720-732 may include respective actuator portions 720*a*-732*a* and respective rotational or mounting portions 720*b*-732*b*. The actuation portions 720*a*-732*a* may engage and/or squeeze the tubes 600-610. As discussed above, the tube 600-610 may be formed of a selected flexible material such as silicone rubber. For example, the tube 600-610 may have a durometer of about 20 shore A to about 70 shore A, including about 30-40 shore A and/or selected increments therebetween. Accordingly, the squeeze arms 720-732 may be actuated to squeeze the selected tubes 600-610 by pressing the squeeze or actuator portion 720*a*-732*a* into the respective tubes 600-610 to compress the selected tubes 600-610 to minimize and/or eliminate flow of the selected material therethrough.

The mounting portion 720*b*-732*b* may be mounted to a portion of the housing 680 of the valve assembly 570 to allow the movement and/or rotation of the squeeze assemblies, including the actuation portions 720*a*-732*a*, relative to the respective tubes 600-610. As discussed herein, the actuator 684 may actuate the squeeze portions of the squeeze arms 720-732 to compress or squeeze selected portions of the tube 600-610 to eliminate or minimize the flow through the respective tubes. Thus, the squeeze arms 720-732 may be moved or actuated by the actuator 684 to engage the tubes 600-610 to squeeze them closed or restricted. The actuator 684 may also move to release the squeeze arms 720-732 to allow the one or more tubes 600-610 to open, such as due to elasticity of the tubes 600-610.

With continuing reference to the above and further reference to FIG. 12, FIG. 13, FIG. 14, and FIG. 15, the valve assembly 570 may be operated to move the actuators 684 relative to the respective actuators or squeeze members 720-732 relative to the respective tube members 600-610. Generally, the motor 692 may be operated to rotate the actuator 684 around an axis 740. The actuator 684 may be operated to rotate in a bi-directional direction, for example, as illustrated by arrows 744 around the axis 740. Therefore, the actuator 684 may rotate to move in two directions around the axis 740, based upon operation of the motor 692.

The motor 692 may include a spindle or axle 148 that may engage a central bore or opening 750 of the actuator 684. The actuator 684 may rotate relative to one or more bearings, such as a first bearing 754, and a second bearing 758. The two bearings may be mounted or held within the portions of the housing 680 of the valve assembly 570. The housing 680 may include a first or squeeze section housing 758 where the bearing 754 may be held within a bearing mount 760. The housing 680 may further include a second housing portion or main housing portion 762 that includes a second bearing mount or portion 764. The two housing portions 758, 762 may be positioned relative to one another via a main bearing or valve housing portion 768. Further, the motor 692 may be held within amount 772 and/or the main mount 762. The motor mount 772 may hold and/or protect the motor 692 relative to movement and/or abrasions relative to the valve assembly 570. Thus, the housing 680 of the valve assembly 570 may be connected or formed of a plurality of members. As discussed above, however, the valve housing 680 may be formed of a single member or less than three members. Nevertheless, the actuator 684 may rotate relative to the housing 680 to rotate in the direction of arrow 744. The motor of 692 may be operated to rotate the actuator 684.

The processor assembly 688 may operate the motor 692 to move the actuator 684 relative to one or more of the tubes 600-610. The various tubes are positioned through one or more bores or openings formed in the valve assembly 570 including the respective bores 780, 784, 788, and 792. It is understood that bores may be formed in any portion of the valve assembly 570 and the bore portions 780-792 illustrated in the squeeze sections 758 is merely exemplary. Nevertheless, the actuator 680 may be moved relative to the bores 780-792 in the squeeze portion 758 that may include and/or allow for passage of the tube 600-610.

Figure 16:
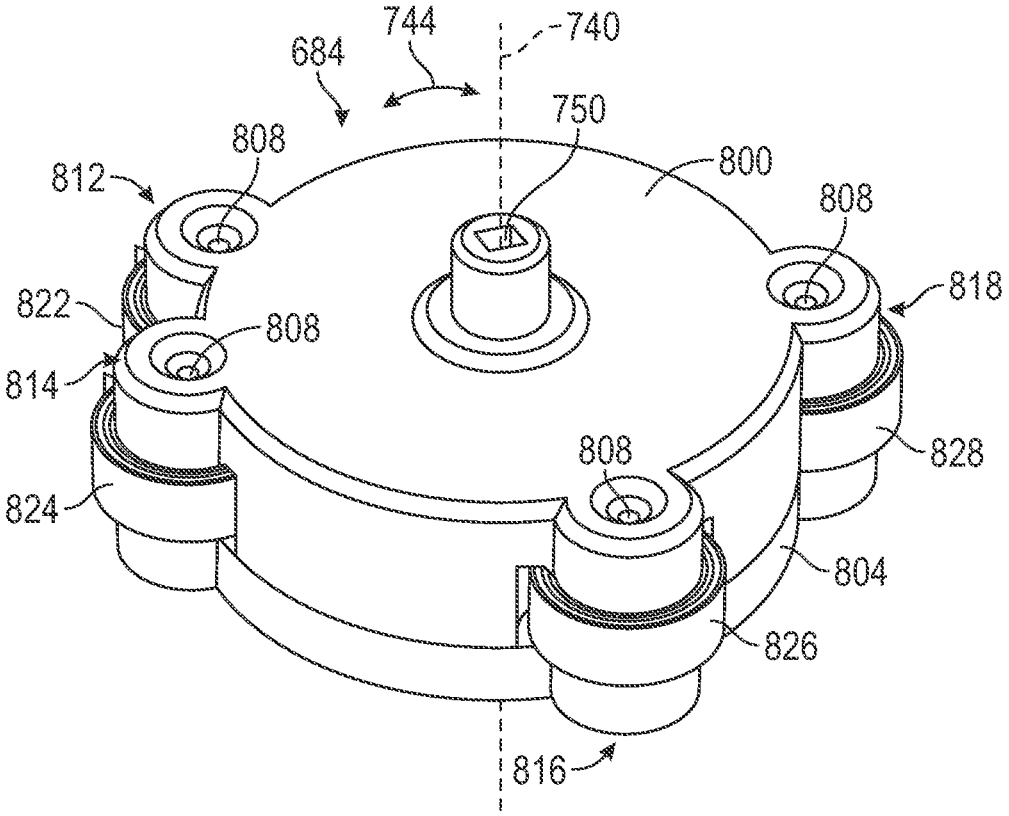
FIG. 16 is a top perspective view of an actuator of the valve assembly, according to various embodiments.

The actuator assembly 684 may include various portions or assemblies that may be provided as a plurality of members and/or formed as a single member. According to various embodiments, however, the actuator assembly 684, is illustrated in FIG. 16, may include a top plate or cap 800 and a second or bottom cap 804. The two caps 800, 804 may be assembled or held together with one or more fasteners, such as a fastener portion or member 808. The fastener member 808 may include a screw that engages both the caps 800, 804 to hold the assembly together. The actuator assembly 684 may include one or more lobes or actuator portions that extend from the central hub or engagement portion 750 that may be engaged by the motor axle 748. For example, as illustrated in FIG. 16, the actuator assembly 684 may include a first lobe or projection 812, a second projection 814, a third projection 816, and a fourth projection 818. The number of projections may be selected based upon the number of passages through the valve assemblies 570 and/or any appropriate configuration thereof. Nevertheless, the projections 812-818 are provided to engage one or more of the tubes 600-610, such as via the squeeze arms 720-732.

In various embodiments, a bearing may be provided with each of the projections. For, example, a first bearing 822 may be provided but the first projection 812 is second bearing 824 may be provided but the second projection 814, a third bearing 826 may be provided with the third projection 816 and a forth bearing 828 may be provided with the fourth projection 818. The respective bearings 822-828 may assist and/or allow for smooth transitions of the engagement of the respective tubes 600-610 for operation of the vale assembly 570. The bearings 822-828 may rotate relative to the respective plates 800, 804 and/or the fasteners 808. The bearings 822-828, therefore, may assist in and/or provide an efficient operation of the actuator 684 and, therefore, the valve assembly 570.

The actuator 684 may be rotated around the axis 740 generally in the direction of the double head arrow 744 to engage the respective tubes 600-610 via the squeeze members 720-732. The position of the actuator member 684 may be determined based upon the proximity sensors 700-710, as discussed above. The proximity sensor may sense various portions of the actuator 684, such as one or more of the fasteners 808. The actuator 684 may have specific identification members, such as radio frequency (RF) tags, in addition or alternatively to the fasteners 808. Further the proximity sensors 700-712 may be provided to indicate a number of passes or distance between passes to identify a position of the actuator 684.

Further, the axle 748 may include an appropriate cross-section to engage with bore 750 of the actuator 684. The axle 748 may be keyed to the bore 750 to allow an interference fit to move the actuator 684. Therefore, the actuator 684 may be operated due to an engagement of the axle 748 with the bore 750. The actuator 684 may, thus, be rotated in the direction of the double headed arrows 744.

Accordingly, the valve assembly 570 may be operated to move the actuator 684 to engage one or more of the squeeze members 720-732, as discussed herein, to restrict or eliminate flow of a fluid through one or more of the tubes 600-610. Thus, the valve assembly 570 may be used with the heater assembly 500 to control flow of a fluid through the heater assembly 500 between one or more portions of the portable sink 20, or any appropriate system.

As discussed above, the heating assembly 500 may include various components, including the valve assembly 570. The valve assembly 570 may be operated, according to various embodiments. As illustrated and discussed above, various elements may be used to determine the position of the actuator 684. In various embodiments, the proximity sensors 700-712 may sense one or more selected portions of the actuator 684, such as the fasteners therein. It is understood, however, that various other portions may be provided with the actuator 684 to be sensed by the proximity sensors.

Figure 17:
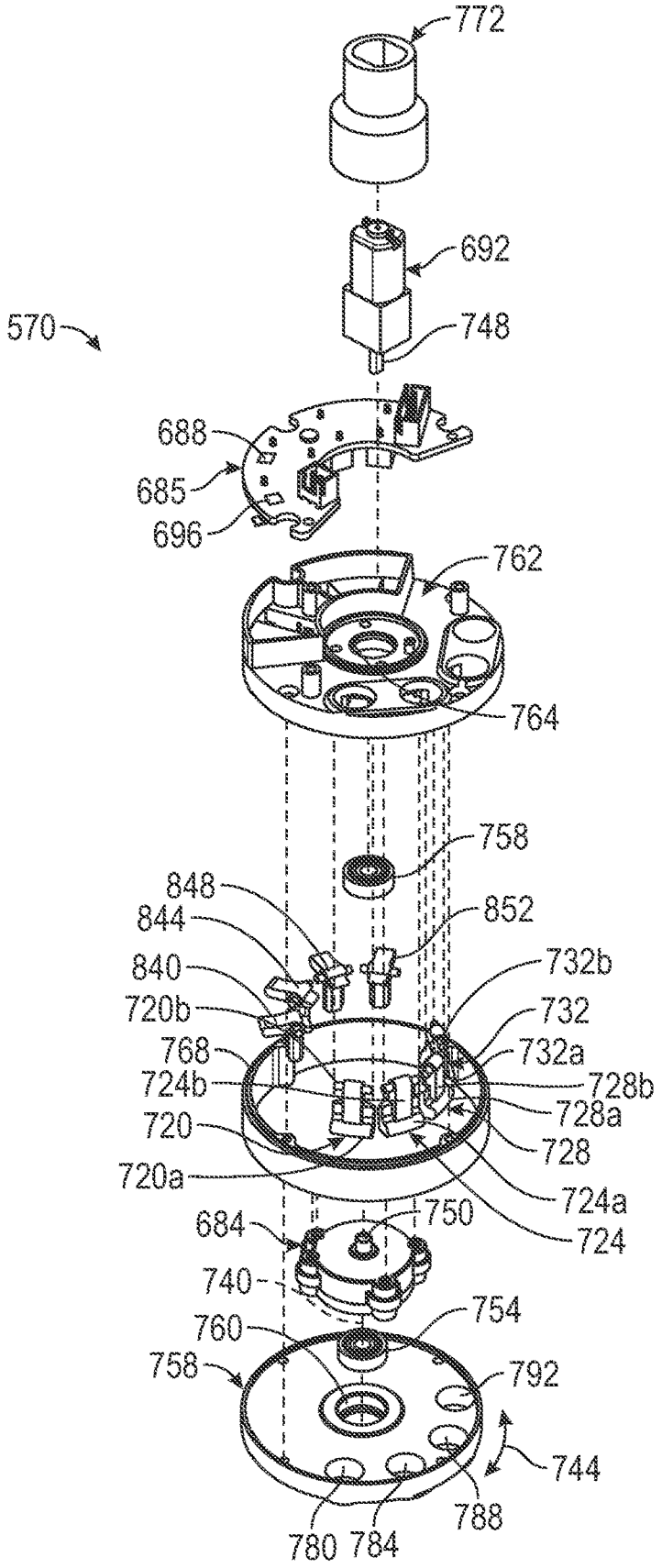
FIG. 17 is a top perspective exploded view of a valve assembly, according to various embodiments.

According to various embodiments, as illustrated in FIG. 17, additional or alternative mechanical and/or sensor portions may be used to sense a position of the actuator 684. For example, one or more actuator arms or selector arms may be used. For example, a first actuator arm 840, a second actuator arm 844, a third actuator army 848, and a fourth actuator army 852 may be provided. This selected number of actuator arms may be selected based upon possible positions of the actuator 384 and/or required granularity of positions determination. Nevertheless, the actuator arms 840-852 may be engaged by one or more of the projections of the actuator 684, such as the projection 822 and 824. The actuator arms may then move and engage a sensor, such as one or more sensors on the board 685. The sensor on the board, after being engaged by the selector arms 840-852, may then provide a signal to the processor 688 to allow for a determination of the position of the actuator 684 around the axis 740. Similar to the proximity sensor 700-712, therefore, a rotational position of the actuator 684 may be determined. This allows for a determination of which one or more or none of the squeeze arms 720-732 are engaged to squeeze one more of the tubes 600-610 in the valve assembly 570.

Accordingly, the valve assembly 570 may include various position sensors to determine and/or confirm a position of the actuator 684. The position of the actuator 684 may determine in which configuration the valve assembly 570 is. The configuration of the valve assembly 570 may be based upon which one or more or none of the squeeze arms are squeezing one or more of the tubes of the valve assembly 570 and/or rotational position of the actuator 684.

As noted above, the valve assembly 570 may be provided in various configurations for operation of a selected system, such as the portable sink 20. As discussed above, the valve assembly 570 may be provided in any appropriate system. Further, the valve assembly 570 may include more or fewer of the noted portions herein to achieve more or fewer configurations.

Figure 18B:
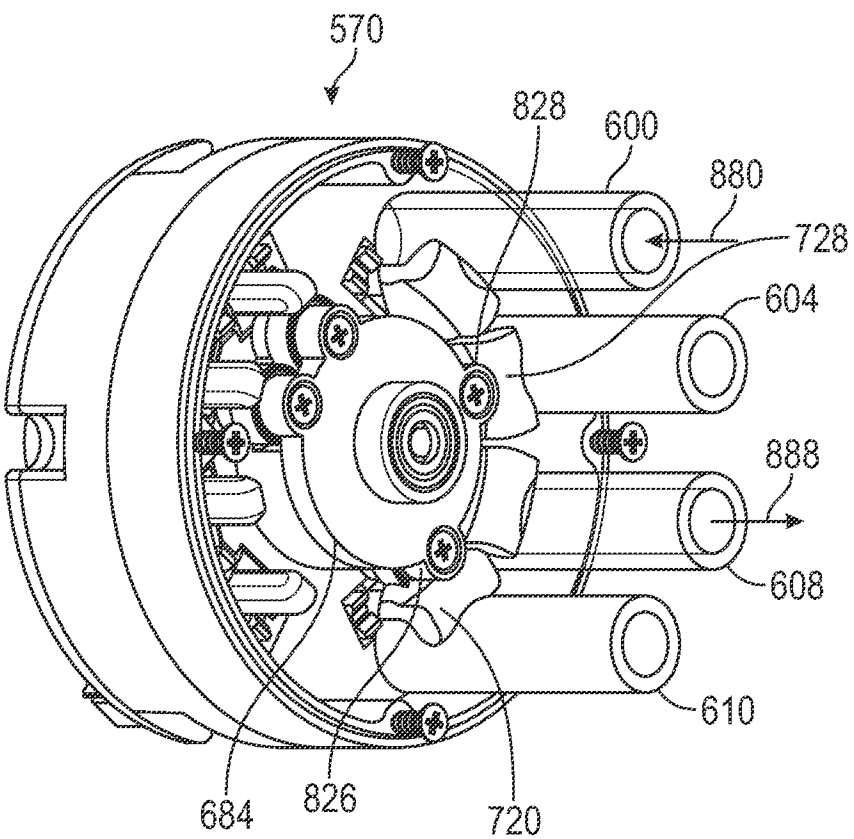
FIGS. 18A and 18B are opposite end perspective views of the valve assembly in a first configuration, according to various embodiments.
Figure 18A:
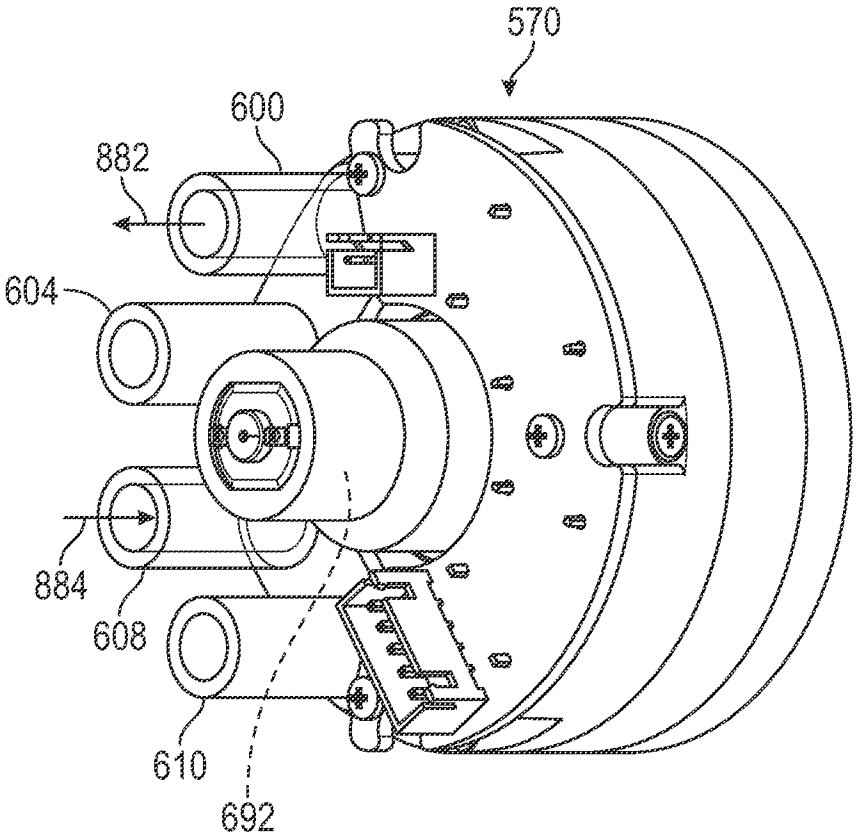
Figure 19B:
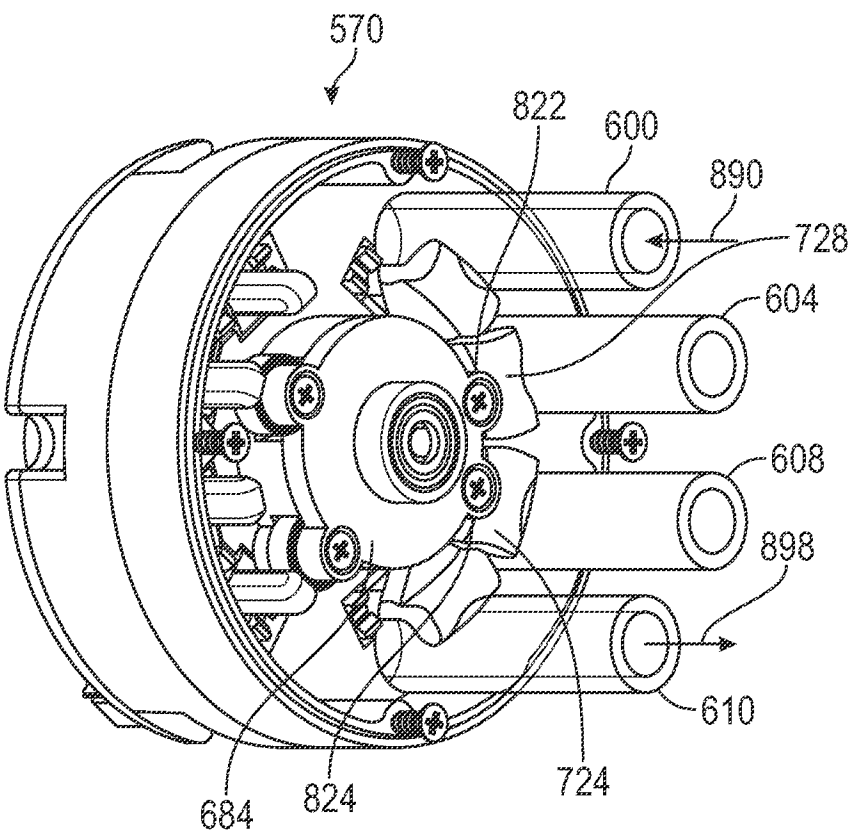
FIGS. 19A and 19B are opposite end perspective views of the valve assembly in a second configuration, according to various embodiments.
Figure 19A:
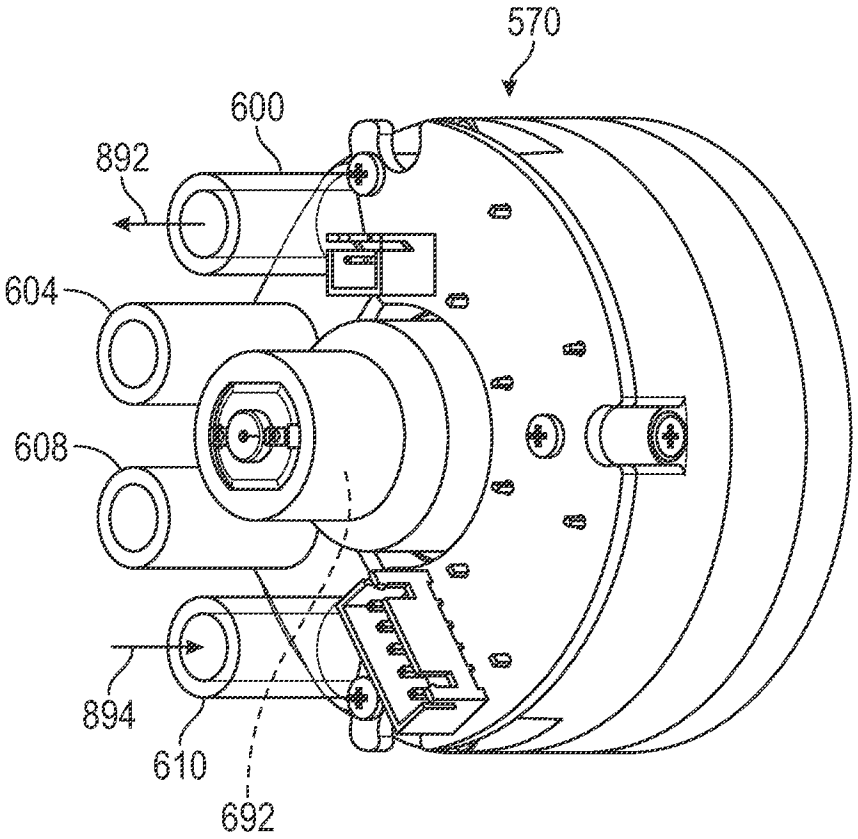
Figure 20B:
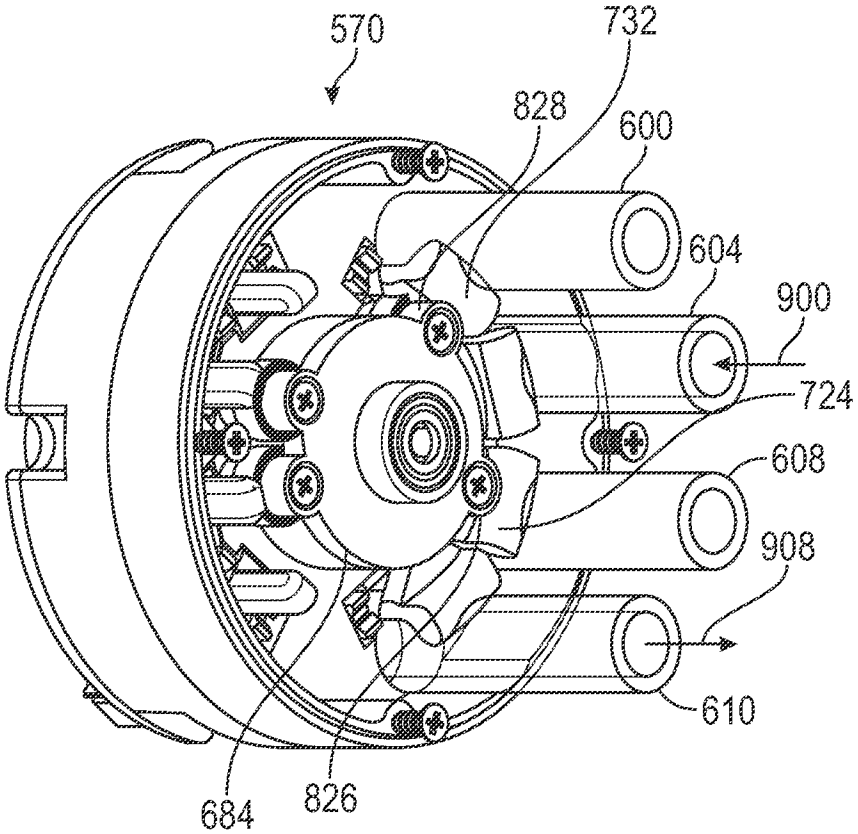
FIGS. 20A and 20B are opposite end perspective views of the valve assembly in a third configuration, according to various embodiments.
Figure 20A:
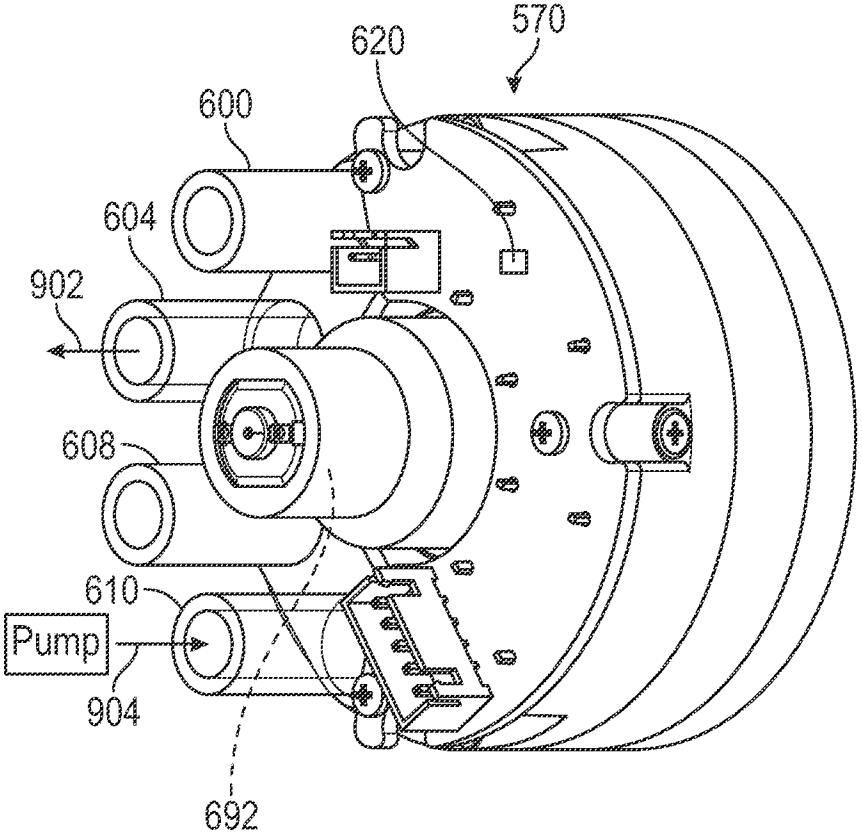

According to various embodiments of the valve assembly 570 of the heater assembly 500 may be provided in a dispensing configuration, as illustrated in FIGS. 18A and 18B, a circulating configuration as illustrated by FIGS. 19A and 19B, or a drain configuration as illustrated in FIGS. 20A and 20B. Again, as discussed above, various additional passages or tubes may be provided in the valve assembly to provide for other configurations and these configurations are merely exemplary. Further, the position of the actuator 684 to squeeze the respective tubes with the respective squeeze arm allows for operation of the heater assembly 500 in the selected manner. As discussed above, the pump assembly 530 may be operated to move water through the heater assembly 500. Therefore, regardless of the configuration of the valve assembly 570, the pump 530 may not be operated such that water, or any appropriate fluid, is not flowing or any other selective fluid is now flowing through the heater assembly 500.

With reference to FIGS. 18A and 18B, the valve assembly is illustrated in opposite perspectives. For example, as illustrated in FIG. 18B, the actuator 684 is illustrated to have the tube lobes or projections 826 and 818 as engaging the respective squeeze arms 720 and 728. The squeeze arms 720 and 728 squeeze against the respective tubes 604 and 610 to close or restrict the respective tubes and stop or restrict a flow of fluid therethrough. Accordingly, a flow of fluid may be allowed through the tubes 600 and 608 while it is eliminated or restricted through tubes 604 and 610. Thus, the valve assembly 570 allows for a control of a flow of a fluid through the valve assembly 570 that may be placed within the heat assembly 500.

As illustrated in FIGS. 18A and 18B, the flow is indicated by the various direction arrows and may occur when the pump assembly 530 is operating. As discussed above, water may flow through the spigot assembly of the portable sink 20 when selected. Various sensors and/or switches may be used to send a signal to the heater assembly 500 to operate the pump assembly 530. If the signal is to dispense water, the valve assembly 570 may move to the dispensing configuration as illustrated in FIGS. 18A and 18B. Therefore, the squeeze arms 720 and 728 may close the tube 604 and 610. The pump may then begin to operate and cause fluid to flow, such as water, as illustrated in FIGS. 18A and 18B.

The flow direction as illustrated in FIGS. 18A and 18B, for example, may flow from or be drawn into the heater assembly 500 through the tube 600 from the tank volume 66 generally in the direction of the arrow 880. Water may be drawn through the tube 600 into the pump continuing in the direction of the arrow 880 and further in the direction of the arrow 882. The water may then move from the pump through the tube 608 generally in the direction of arrow 884 and toward the spigot in the direction of arrow 888. Therefore, the water may flow through the heater assembly 500, as illustrated above, such as through the inlet port 512 and further through the tube 600 in the valve assembly 570. Therefore, the water may pass through the heater 650 which may be operational, if selected, and the sanitation assembly 620 to be sanitized, also if selected to operate. The water then may travel or be directed via the valve assembly 570 and through the outlet 514 to spigot assembly.

As illustrated in FIGS. 18A and 18B, the position of the actuator member 684 may be determined by lobes engaging the selector arms, as noted above and/or the proximity sensors as also discussed above. Accordingly, the position of the actuator 684 may be determined. The actuator 684 may be rotated relative to the squeeze arms 720, 728 due to the motor 692 that is mounted with the valve assembly 570. Thus, the motor 692 may be operated to move the actuator 684 to a selected position to close or restrict flow through the tube 604 and 610 allowing flow through the tube 600 and 608 to allow dispensing of water from the assembly, including the portable tank sink assembly 20. The motor 692 may be controlled with the processor or any appropriate processor module based on various received signals and/or inputs. For example, a signal to dispense water may be received and the processor may automatically control the motor 692 to move the actuator 684 to configure the valve assembly and also power the pump 530. Additionally or alternatively, a signal may be separately sent to the pump to operate.

According to various embodiments, the water may be dispensed trough the spigot 50 with an input from an input system or assembly 921. For example, the input system 921 may be a physical switch and/or a hands free, such as proximity sensor. The proximity sensor may be an infrared and/or photoelectric sensor, such as those sensos sold by AutomationDirect. The input system 921 may be connected to the heater assembly 100, 500 with a connection 923. The connection may provide power to the input system 921. Further, the connection 923 may allow for the input system 921 to send a signal to one or more controller in the sink 20, such as in the heater assembly 100, 500. The controller of the heater assembly 100, 500 may control one or more portion of the heater assembly based on the input.

According to various embodiments, the input system 921 may send a signal that a hand or object is sensed. The controller may then operate the pump 530 and/or the valve 570. The controller may move the valve 570 to the dispense configuration and the pump 530 may be powered on for a selected time period and/or cycles. Thus, water may be dispenses with from the spigot 50 substantially automatically and/or handsfree with the input system 921 that may transmit a signal to the heater assembly 100, 500 and/or another appropriate pump assembly.

The valve assembly 570, as noted above, can also be placed into the circulation configuration as illustrated in FIGS. 19A and 19B. In the circulation configuration water is passed through the heater assembly 500 from the tank and returned to the tank. Therefore, water in the tank may be maintained at a selected set and/or threshold temperature. As discussed above, various sensors may be positioned either in the heater assembly 500 and/or in the tank assembly 66 to measure temperature of the water therein. Therefore, the valve assembly 570 may be positioned in the circulation configuration and the pump assembly 530 may be operated to circulate water from and return it back to the tank assembly when a selected temperature is reached and then the pump may be ceased or stopped when a selected temperature. The set or threshold temperature may be any appropriate temperature, such as greater than 5 degrees C., has been reached. Again the processor module may configure the valve assembly 570 and/or operate the pump 630 automatically based on selected inputs (e.g., temperature signal from a temperature sensor).

In the circulation configuration, the motor assembly 692 may be operated to move the actuator assembly 684 relative to the squeeze arms and the respective tubes. As illustrated in FIGS. 19A and 19B, the actuator projections 822 and 824 may engage or press on their respective squeeze arms 728 and 724 to squeeze or close the respective tubes 604 and 608. Therefore, the flow through the tubes 604 and 608 may be substantially eliminated or stopped by the squeeze arms. 724, 728. Again, a position of the actuator 684 may be determined such as with the selector arms and/or the proximity sensors as discussed above. That is the position of the actuator 684 may be known and the processor system 688 may operate the motor 692 to move the actuator 684 to the selected position.

When the squeeze arm closes the tube 604 and 608 and the pump assembly 530 is operating water may flow through the other two tubes 600 and 610. Therefore, water may flow from the water tank generally the direction of arrow 890 through the tube 600 into the pump in the direction of arrow 892 through the tube 600. Water then may return from the pump generally in the direction of arrow 894 through the tube 610 and back to the tank through the tube 610 generally in the direction of the arrow 898. The water may enter the heater assembly 500 through the inlet 512 and pass through the heater assembly 650. The water may then flow through the valve assembly 570, as discussed above, through the pump assembly 530 and out through the second heater 654. The water may then exit through the outlet 508 and return to the tank 66. Thus, the water may circulate through the heater assembly 500, including the heater elements member 650 and 654 to raise or add thermal energy to the water. By adding thermal energy to the water, the temperature of the water may be raised to a selected temperature. By returning the heated water to the tank 66 the water in the tank may be maintained or raised to a selected temperature. The increasing of the temperature of the water in the tank may assist in minimizing or eliminating freezing of water in the tank and ensure operation of the portable sink assembly 20. Thus, the heater assembly 500 may be operated in the circulation mode with the valve assembly 570 appropriately configured, to allow for circulation of water through the heater assembly 500 without dispensing water and/or draining water from the portable sink 20.

Turning reference to FIGS. 20A and 20B, the valve assembly 570 may be configured to drain water from the heating assembly 500 and/or other portions of the fluid transfer lines interconnected with the heater assembly to the liquid tank 66. As is understood by one skilled in the art, if a fluid passage is filled with a liquid and sealed the fluid may not drain from the fluid passage. Further, if pressure is applied to a fluid container the fluid may remain in the container until the pressure is relieved, or a drain is opened. Accordingly, if the heating assembly 500, such as the heaters 650, 654, the UV sanitation portions 620, 624, or other portions are filled with water until a pressure release is provided. Accordingly, the valve assembly 570 may be configured to a drain configuration, is illustrated in FIGS. 20A and 20B. The drain configuration may also drain water from the spigot assembly to the volume container.

The actuator 684 may be moved to actuate or move the squeeze arms 724 and 732. Therefore, the squeeze arms may be moved to close the tubes 600 and 608 to substantially eliminate or reduce passage of fluid therethrough. Again, as discussed above, the squeeze members may include portions that compress or push on the respective tubes, such as the tubes 600 and 608, to reduce or eliminate an opening therein. This fluid is not able to pass the portion of the tube by the respective squeeze members, such as the squeeze members 724 and 732, with the pressure provided by the pump assembly 530, according to various embodiments. The squeeze members may rotate relative to portions of the valve assembly 570, as discussed above. The actuator member 684 may be moved such that the lobes or projection 828 and 826 may engage or push on the respective squeeze members 732, 724. Again, according to various embodiments, the actuator member 684 may engage one or more of the selector arms and/or be sensed at a position by the proximity sensors. Therefore, the processor 680 on the board may know the position of the motor 692 and operate the motor to move the actuator to a selected position, as illustrated in FIG. 28*b*.

When the actuator 684 is in the selected position, as illustrated in FIGS. 20A and 20B, the squeeze members close or restrict the tubes 600 and 608. In this configuration, air may move generally in the direction of the arrow 900 through the tube 604 to the water pump generally in the arrow of 902. Water from the pump, and other portions of the heater assembly may then move in generally the direction of arrow 904 through the tube 610. The water from the heater assembly and/or the spigot assembly may also then pass generally in direction of arrow 908 to the water storage tank 66. Thus, in the configuration of the valve assembly 570 is illustrated in FIGS. 20A and 20B the water that is not in the tank 66 may be drained back into the tank by allowing a release of pressure and/or a backfilling of air from the spigot into the heater assembly 500. Therefore, water contained within the heater assembly 500 may be drained out of the heater assembly 500 to the tank.

The valve assembly 570 may be moved to the drain configuration in any appropriate manner. For example, the valve assembly 570, the heater assembly 500, or other portion may include a power storage system, such as a battery, to allow for the actuator 684 to be moved to the drain configuration. Therefore, any time a selected loss of power and/or signal is sent to the drain configuration can be obtained as the valve assembly 570 to ensure release of pressure from the heater assembly 500. This may allow a removal of water from the heater assembly 500 to reduce and/or eliminate a volume of water from being maintained within the heater assembly 500 to reduce or eliminate possible cracking or breaking of the heater assembly 500 if water in the heater assembly 500 freezes and expands.

The valve assembly 570 may be moved to various configurations, as noted above. Further, the pump may be operated, also in various configurations, and based upon input from one or more controllers, such as the controller with the heat assembly included in the board 527 that may include one or more processors 529. The processor 529 may include a memory and/or access a memory to execute instructions for operating of the heater assembly 500 in the portable sink 20. According to various embodiments, the heater assembly 500 may be connected to a battery and/or include an internal battery or other power storage system. The power storage system may be used to move the valve assembly 570 to a selected and/or safe configuration, such as the drain configuration. As noted above, the drain configuration may allow for removal of water from the heater assembly 500 to assist in removing or eliminating a possibility of damage to the heater assembly 500 if the heater assembly freezes with water therein. Additionally, maintaining water in the heater assembly 500 during extended periods of non-use may also not be selected.

Figure 21:
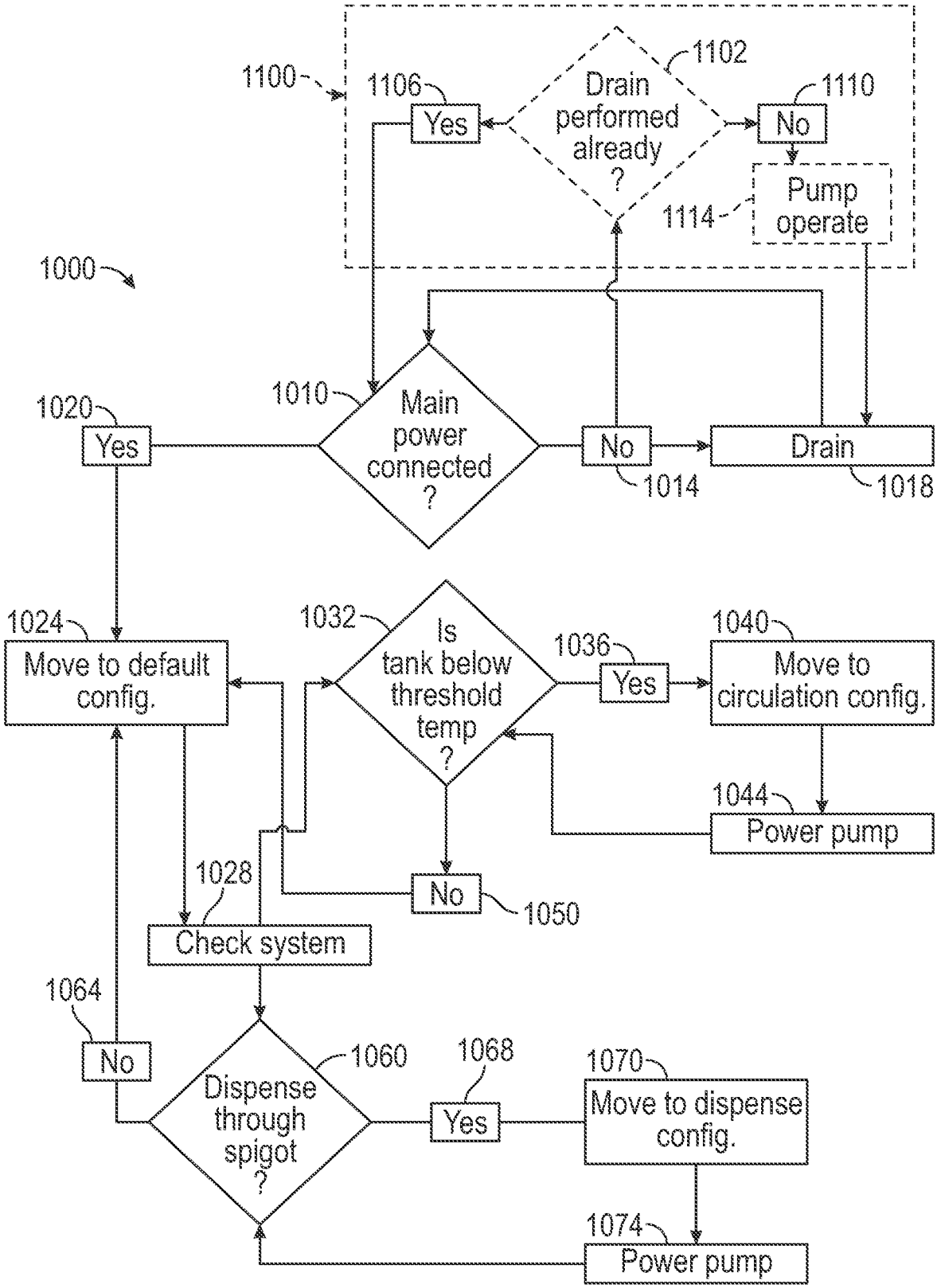
FIG. 21 is a flow chart of a process for operation of the heater assembly.

Accordingly, with reference to FIG. 21, a process 1000 may be used to operate the heater assembly 500. The process 1000 may be an iterative process or repeated to operate to the heater assembly 500. According to various embodiments, the process 1000 may begin in block 1010 when main power is connected and/or main power is turned on for the portable sink 20 and/or the heater assembly 500. As discussed above, power may be connected to the heater assembly 500 for operation thereof.

If main power is not connected a NO path 1014 may be followed to move the valve assembly to the drain configuration in block 1018. As discussed above, any battery other power storage system may be used to provide power to the valve assembly 570 to be able to be moved to the drain configuration when main power is not connected. Therefore, a safe mode or safe configuration may always be maintained over the valve assembly 570 included with the heater assembly 500.

The drain configuration may be a gravity system, as noted above. In various embodiments, a powered drain may optionally occur. With reference to the subblock 1100 a powered drain is described.

The powered drain 1100 may follow the NO path 1014 to a decisions block of whether a drain has already occurred in block 1102. If a drain has already occurred a YES path 1106 may be followed. The YES path 1106 may return to the determination of whether main power is connected in block 1010. Thus, the system may again iterate or wait a selected time period to make further determinations.

The powered drain process 1100 may also determine that no drain has occurred, such as after a previous configuration or a certain period of time. If no drain has previously occurred, a NO path 1110 may be followed. When the NO path 1110 is followed, a pump operation 1114 may occur. That is, the pump assembly 530 may be operated, such as powered with the battery of the heater assembly 500 and controlled with a selected controller. The pump may draw air from the spigot 50 and pump the air through the heater assembly 500. Thus, the drain may be powered via the pump rather than only gravity drain. Further, the process may be substantially automatic based on the process 1000 that may be operated and/or included with instructions executed by a selected processor.

If main power is connected a YES path 1020 may be followed. The YES path 1020 may follow to move the valve configuration to a default configuration in block 1024. The default configuration may be any appropriate configuration such as the drain configuration, the dispensing configuration, and/or the circulating configuration. The default configuration may be selected based upon applications of the portable sink, applications of the heater assembly 500, or other appropriate selections. Nevertheless, the default configuration for the valve assembly may be made in block 1024. A check or monitoring of the system may then happen in block 1028. In checking the system, it may be determined or selected signals may be received for operation of the valve assembly 570 of the heater assembly 500. For example, a temperature sensing may be made of the temperature in the tank 66 and/or of the water in the tank 66 in a determination of whether the tank is below a threshold temperature may be made in block 1032. If the tank is below a threshold temperature in block 1032, a YES path 1036 may be followed to move the valve configuration to a circulation configuration in block 1040. The pump may also be powered in block 1044. Therefore, with the valve assembly 570 in the circulation configuration and the pump powered in block 1044 the water may be circulated through the heater assembly 500. The system may then iterate to the decision block 1032 of whether the temperature in the tank is at a threshold temperature. If it is below a threshold temperature, the YES path 1036 may continue to be followed and loop back to the determination block 1032. However, if it is determined that the threshold temperature is not below a threshold temperature, a NO block 1050 may be followed. The system may then iterate back to move the valve to the default configuration block 1024.

Again, after a selected period of time or at a selected rate, the system may loop to check block 1028. The check system may check to determine any appropriate system status, such as the tank temperature and/or a dispensing. The system may include a selected priority, such as dispensing higher than circulation. However, any appropriate system check may be made.

After the system check in block 1028, a determination of whether to dispense through the spigot may be made in block 1060. A determination of whether a dispensing should be made through the spigot in block 1060 may include whether a sensor has been activated to dispense, a user selectable switch has been activated, or the like. If no sensed signal to dispense is made in block 1060, a NO path 1064 may be followed to move the or maintain the valve assembly in the default configuration block 1024.

If a determination is made that dispensing through the spigot should be made, a YES path 1068 may be followed. The valve assembly may then be moved to a dispense configuration in block 1070 and the pump may be powered to block 1074. The pump being powered with the valve assembly and the dispense configuration may then dispense water through the spigot assembly, as discussed above. Again, the process 1000 may then iterate to determine whether dispensed through the spigot is being maintained and if the YES path 1068 may be followed. If not, the NO path 1064 may be followed to move the system to the default configuration and block 1024.

Therefore, the process 1000 may be used to operate the heater assembly of 500 in the selected usage, such as in the portable sink 20. The process 1000 allows for configuring the valve assembly 570 based upon selected inputs and/or lack thereof. Thus, the heater assembly 500 may be automatically drained when a main power is not connected and/where main power switch is not operated to drain water from the heater assembly 500. Further the heater assembly 500 may receive signals and/or be operated by selected processor systems to move the valve assembly 570 to selected configurations to achieve selected operation, as discussed above.

The heater assembly 500 may include one of our processors or processor modules and/or receive commands and controls therefrom, as discussed above. The processor modules may execute selected instructions to perform various functions, such as operating the valve assembly 570 and/or the pump assembly 530 and other portions, including the heater assemblies and/or the sanitation portions. Each of the portions may be operated substantially automatically based upon the execution of the instructions and/or receiving signals at the heater assembly 500. Accordingly, it is understood that once the heater assembly is installed in the selected position, such as the portable sink 20, the heater assembly 500 may operate substantially automatically based upon the instruction stored therein and the receiving of various signals or inputs.

As noted above, a controller or control system may include one or more processor or processor modules. The processor may be any appropriate processor as discussed herein. Thus, the heater system 500 may be operated substantially automatically. This may reduce required manual maintenance and/or inputs. Further, while an exemplary portable sink is disclosed, the heater assembly 500 may be used in any appropriate system. Further, the valve assembly 570 may be used with any appropriate system, and not only the heat assembly 500 and/or portable sink 20. Thus, one skilled in the art will understand that the subject disclosure includes various exemplary embodiments, but the disclosure is not limited thereto. Further, the various embodiments may be mixed together and/or various portions removed as is understood by one skilled in the art.

According to various embodiments a selected system may include a clean water volume and a gray water volume. Fluid connections may be provided between the clean water volume container and the gray water volume container. A heater may be positioned within the clean water volume container and operable to transfer thermal energy to water placed in the clean water volume container. A pump operable to pump water past the heater. A controller having a processor module may be configured to execute instructions to operate the pump and the heater maintain a set temperature of the water within the clean water volume. Water may be contained entirely in the clean water volume container and is selectively transferred to the gray water volume container. The heater may be a submersible heater configured to be at least partially submerged within water to transfer the thermal energy thereto. The heater and the pump may be fluidly connected as a single unit and positioned within the clean water volume container. The controller, the heater, and the pump may be connected and/or enclosed as a single unit and positioned within the clean water volume container. A temperature sensor may be connected to the controller to sense a temperature of the water within the clean water volume container and transmit a signal related thereto to the controller. The controller may operate at least one of the heater or the pump based on the signal from the temperature sensor to achieve the set temperature. The clean water volume container and the gray water volume container may be connected as a single unit and configured to be selectively positioned by a user. The selected system may be a portable sink that may be moved to a selected location and operated thereat without a connected to a water source separate from the clean water volume container. A power conduit may deliver power to at least one of the heater, the pump, or the controller.

According to various embodiments, a method of operating a portable sink to maintain a set temperature of a water positioned in a clean water volume container is disclosed. The method may include positioning a heater within the clean water volume container, providing the heater to transfer thermal energy to water placed in the clean water volume container, positioning a pump to pump water past the heater, and providing a controller having a processor module that may execute instructions to operate the pump and the heater maintain a set temperature of the water within the clean water volume. The method may further include placing water in the clean water volume container. The method may further include powering on the at least one of the controller, the pump, or the heater. The method may further include sensing a current temperature of the water in the clean water volume container.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

It should be understood that various aspects disclosed herein may be combined in different combinations than the combinations specifically presented in the description and accompanying drawings. It should also be understood that, depending on the example, certain acts or events of any of the processes or methods described herein may be performed in a different sequence, may be added, merged, or left out altogether (e.g., all described acts or events may not be necessary to carry out the techniques). In addition, while certain aspects of this disclosure are described as being performed by a single module or unit for purposes of clarity, it should be understood that the techniques of this disclosure may be performed by a combination of units or modules associated with, for example, a medical device.

In one or more examples, the described techniques may be implemented in hardware, software, firmware, or any combination thereof. If implemented in software, the functions may be stored as one or more instructions or code on a computer-readable medium and executed by a hardware-based processing unit. Computer-readable media may include non-transitory computer-readable media, which corresponds to a tangible medium such as data storage media (e.g., RAM, ROM, EEPROM, flash memory, or any other medium that can be used to store desired program code in the form of instructions or data structures and that can be accessed by a computer).

Instructions may be executed by one or more processors, such as one or more digital signal processors (DSPs), general purpose microprocessors, graphic processing units (GPUs), application specific integrated circuits (ASICs), field programmable logic arrays (FPGAs), or other equivalent integrated or discrete logic circuitry. Accordingly, the term "processor" as used herein may refer to any of the foregoing structure or any other physical structure suitable for implementation of the described techniques. Also, the techniques could be fully implemented in one or more circuits or logic elements.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A fluid volume containing system, comprising:

a clean water volume container;

an outlet fluidly connected to the clean water volume container;

a heater assembly positioned within the clean water volume container and operable to transfer thermal energy to water placed in the clean water volume container;

a pump assembly operable to pump water past the heater;

a controller having a processor module configured to execute instructions to maintain a set temperature of the water within the clean water volume by operation of the heater and pump water out of the outlet by operation of the pump; and a valve system having at least a first configuration, a second configuration, and a third configuration;

wherein the valve system moves between the first configuration, the second configuration, and the third configuration based on being controlled at least in part by the controller.

2. The system of claim 1, further comprising:

a portable sink assembly containing all of the clean water volume container, the outlet fluidly connected to the clean water volume container, the heater assembly, the pump assembly, and the controller.

3. The system of claim 2, further comprising:

a gray water volume container;

wherein the gray water volume container is contained within the portable sink assembly; and wherein water contained in the clean water volume container is operable to be selectively transferred to the gray water volume container.

4. The system of claim 2, wherein at least one of the first configuration or the second configuration is a drain configuration, a circulation configuration, or a dispense configuration.

5. The system of claim 2, wherein the heater assembly is configured to be at least partially submerged in water in the clean water volume container and to transfer the thermal energy to the water.

6. The system of claim 2, further comprising:

a temperature sensor operably connected to the controller to sense a temperature of the water within the clean water volume container and transmit a signal related thereto to the controller.

7. The system of claim 6, wherein the controller operates at least one of the heater or the pump based on the signal from the temperature sensor to achieve the set temperature.

8. The system of claim 2, further comprising:

a sanitation system;

wherein the pump is operable to pump water through the sanitation system.

9. The system of claim 2, wherein the portable sink assembly is configured to be moved to a selected location and operated thereat without a connection to a water source separate from the clean water volume container.

10. A fluid volume containing system, comprising:

a clean water volume container;

an outlet fluidly connected to the clean water volume container;

a heater assembly positioned within the clean water volume container and operable to transfer thermal energy to water placed in the clean water volume container;

a pump assembly operable to pump water past the heater;

a controller having a processor module configured to execute instructions to maintain a set temperature of the water within the clean water volume by operation of the heater and pump water out of the outlet by operation of the pump;

and a temperature sensor operably connected to the controller to sense a temperature of the water within the clean water volume container;

wherein the controller, the heater assembly, and the pump assembly are connected as a single unit and positioned within the clean water volume container.

11. A fluid volume containing system, comprising:

a clean water volume container;

an outlet fluidly connected to the clean water volume container;

a heater assembly positioned within the clean water volume container and operable to transfer thermal energy to water placed in the clean water volume container;

a pump assembly operable to pump water past the heater;

a controller having a processor module configured to execute instructions to operate the pump and the heater to maintain a set temperature of the water within the clean water volume and pump water out of the outlet; and a valve system having at least a first configuration and a second configuration;

wherein the valve system moves between the first configuration and the second configuration based on being controlled at least in part by the controller;

wherein at least one of the first configuration or the second configuration is a drain configuration, a circulation configuration, or a dispense configuration.

12. The system of claim 11, wherein the valve system moves between the first configuration, the second configuration, and a third configuration based on being controlled at least in part by the controller.

13. The system of claim 11, wherein the heater assembly is configured to be at least partially submerged in water in the clean water volume container and to transfer the thermal energy to the water.

14. The system of claim 11, wherein the controller, the heater assembly, and the pump assembly are connected as a single unit and positioned within the clean water volume container.

15. The system of claim 11, further comprising:

a portable sink assembly containing all of the clean water volume container, the outlet fluidly connected to the clean water volume container, the heater assembly, the pump assembly, and the controller.

16. The system of claim 11, wherein the controller, the heater assembly, and the pump assembly are connected as a single unit and positioned within the clean water volume container.

17. A fluid volume containing system, comprising:

a clean water volume container;

an outlet fluidly connected to the clean water volume container;

a heater assembly positioned within the clean water volume container and operable to transfer thermal energy to water placed in the clean water volume container;

a pump assembly operable to pump water past the heater; and a controller having a processor module configured to execute instructions to maintain a set temperature of the water within the clean water volume by operation of the heater and pump water out of the outlet by operation of the pump;

wherein the controller, the heater assembly, and the pump assembly are connected as a single unit and positioned within the clean water volume container.

18. The system of claim 17, further comprising:

a valve assembly having:

a first passage, a second passage, a third passage, a fourth passage, an actuator, and a valve controller, wherein the actuator is configured to be moved relative to all of the first passage, the second passage, the third passage, and the fourth passage to selectively close one or more of the first passage, the second passage, the third passage, and the fourth passage based on the valve controller; and a pump assembly operable to pump water past the valve assembly.

19. The fluid volume containing system of claim 18, further comprising:

a spigot; and wherein the controller having the processor module is further configured to execute instructions to operate the pump and pump fluid out of the spigot.

20. The fluid volume containing system of claim 19, wherein the valve assembly is operable to be placed in at least one of three configurations by the actuating moving to selectively close at least one of the first passage, the second passage, the third passage, and the fourth passage;

wherein the first configuration is to circulate fluid from and to the clean fluid volume container;

wherein a second configuration is to allow the fluid to be pumped to the spigot;

wherein the third configuration is to allow fluid to drain from the heater assembly and allow air to enter the heater assembly from the spigot.

21. The fluid volume containing system of claim 20, wherein in the third configuration air is pumped with the pump assembly to enter the heater assembly from the spigot.

* * * * *